US012751544B2

(12) United States Patent
Nam et al.

(10) Patent No.: US 12,751,544 B2
(45) Date of Patent: Oct. 6, 2026

(54) LAUNDRY TREATING APPARATUS

(71) Applicant: LG Electronics Inc., Seoul (KR)

(72) Inventors: Wansik Nam, Seoul (KR); Hyunggyu Lim, Seoul (KR); Hyungha Kang, Seoul (KR); Jaehyung Kim, Seoul (KR); Semin Jang, Seoul (KR); Taejun Yoon, Seoul (KR); Jongsung Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 64 days.

(21) Appl. No.: 18/833,772

(22) PCT Filed: Jan. 30, 2023

(86) PCT No.: PCT/KR2023/001349

§ 371 (c)(1),
(2) Date: Jul. 26, 2024

(87) PCT Pub. No.: WO2023/146367

PCT Pub. Date: Aug. 3, 2023

(65) Prior Publication Data

US 2025/0151895 A1 May 15, 2025

(30) Foreign Application Priority Data

Jan. 28, 2022 (KR) ..... 10-2022-0012925
Jan. 28, 2022 (KR) ..... 10-2022-0012934
(Continued)

(51) Int. Cl.
*A47B 61/00* (2006.01)
*D06F 58/10* (2006.01)
*D06F 58/20* (2006.01)

(52) U.S. Cl.
CPC ..... *A47B 61/00* (2013.01); *D06F 58/10* (2013.01); *D06F 58/203* (2013.01)

(58) Field of Classification Search
CPC ..... A47B 61/00
See application file for complete search history.

(56) References Cited

U.S. PATENT DOCUMENTS

2020/0080255 A1 3/2020 Chae et al.
2020/0385915 A1 12/2020 Kang et al.

FOREIGN PATENT DOCUMENTS

CN 212052039 U 12/2020
CN 212955854 U 4/2021
(Continued)

OTHER PUBLICATIONS

Office Action in Korean Appln. No. 10-2023-0011785, mailed on Dec. 1, 2025, 5 pages (with English translation).
(Continued)

*Primary Examiner* — Jason Y Ko
(74) *Attorney, Agent, or Firm* — Fish & Richardson P.C.

(57) ABSTRACT

The present invention relates to a laundry treating apparatus comprising: a cabinet having an opening at the front thereof; an inner case provided inside the cabinet to provide an accommodation space for accommodating laundry; and a door rotatably coupled to the cabinet to open and close the opening, wherein the door comprises: a door body which is coupled to the cabinet and configured to shield the opening and provides a space in which air flowing in from the accommodation space flows; a door sealer coupled to the rear surface of the door body to block air in the accommodation space from leaking out to the outside; an inlet provided inside the door sealer to pass through the rear surface of the door body so as to introduce air of the accommodation space into the door body; and a damper which is rotatably coupled to the inlet and selectively opens and closes the inlet.

20 Claims, 16 Drawing Sheets

(a)

(b)

(30) Foreign Application Priority Data

Jan. 28, 2022 (KR) ..... 10-2022-0012938
Jan. 28, 2022 (KR) ..... 10-2022-0012942
Jan. 30, 2023 (KR) ..... 10-2023-0011785

(56) References Cited

FOREIGN PATENT DOCUMENTS

| | | | |
|---|---|---|---|
| KR | 10-2011-0067837 | A | 6/2011 |
| KR | 10-2014-0114649 | A | 9/2014 |
| KR | 10-2019-0068428 | A | 6/2019 |
| KR | 10-2020-0021359 | A | 2/2020 |
| KR | 10-2020-0030414 | A | 3/2020 |
| KR | 10-2021-0000288 | A | 1/2021 |

OTHER PUBLICATIONS

Office Action in Korean Appln. No. 10-2023-0011785, mailed on Jul. 1, 2025, 10 pages (with English translation).
Extended European Search Report in European Appln. No. 23747408.5, mailed on Feb. 14, 2025, 7 pages.
International Search Report and Written Opinion in International Appln. No. PCT/KR2023/001349, mailed on May 11, 2023, 19 pages (with English translation).

(a)

(b)

(b)

(a)

( a )

( b )

( c )

LAUNDRY TREATING APPARATUS

CROSS-REFERENCE TO RELATED APPLICATIONS

This application is a National Stage application under 35 U.S.C. § 371 of International Application No. PCT/KR2023/001349, filed on Jan. 30, 2023, which claims the benefit of Korean Application Nos. 10-2023-0011785, filed on Jan. 30, 2023, 10-2022-0012942, filed on Jan. 28, 2022, 10-2022-0012938, filed on Jan. 28, 2022, 10-2022-0012934, filed on Jan. 28, 2022, and 10-2022-0012925, filed on Jan. 28, 2022. The disclosures of the prior applications are incorporated by reference in their entirety.

TECHNICAL FIELD

The present disclosure relates to a laundry treating apparatus. More specifically, the present disclosure relates to a door disposed in a laundry treating apparatus.

BACKGROUND

In general, a laundry treating apparatus is a concept including a washing machine that soaks clothes in water to create a wet state and then removes foreign substances via a chemical action of detergent and a physical action such as drum rotation, and a drying machine that dries the clothes in the wet state using hot air and steam.

However, recently, a clothes care machine that keeps the clothes in a dry state pleasant and clean without soaking the clothes in water has appeared. Such clothes care machine is able to deodorize the clothes by supplying steam or hot air while the clothes are hung and to perform a refresh stroke of drying or sterilizing the clothes.

Such clothes care machine is able to selectively add fragrance to the clothes, and in recent years, has recently become an important component in the laundry treating apparatuses alongside the washing machine and the drying machine.

Referring to Korean Patent Application Publication No. 10-2020-0057545, an existing laundry treating apparatus includes a cabinet that forms an outer appearance of the apparatus and has an opening defined in one surface thereof, and an inner casing that is disposed inside the cabinet to hang the clothes therein. Additionally, the existing laundry treating apparatus includes a door that is coupled to the cabinet and opens and closes the opening.

In the existing laundry treating apparatus, the door is manufactured in a scheme of independently manufacturing four frames and coupling the frames to each other.

However, the laundry treating apparatus described above has disadvantages that the door manufacturing is complicated and the door is heavy.

In addition, the laundry treating apparatus described above has a structure that allows a machine room and the outside of the door to be in communication with each other, which has a concern that the inside of the inner casing will be contaminated when humidity inside the inner casing is high.

SUMMARY

Technical Problem

The present disclosure is to provide a laundry treating apparatus that prevents the inside of an inner casing from being contaminated by allowing the inside of the inner casing to be in direct communication with the outside of a door to allow air to be discharged.

The present disclosure is to provide a laundry treating apparatus in which the inside of an inner casing and the outside of a door are in selective communication with each other.

The present disclosure is to provide a laundry treating apparatus that includes a door that is integrally formed via injection molding and thus is easy to manufacture, is thin, and is light in weight.

The present disclosure is to provide a laundry treating apparatus that, when glass is attached to a door, prevents the glass from being removed or bending.

The present disclosure is to provide a laundry treating apparatus that, when a metal panel is attached to a door that is integrally formed via injection molding, prevents the metal panel from being removed or bending.

The present disclosure is to provide a laundry treating apparatus that includes a handle that may be easily gripped by a user and may create an aesthetic feeling.

Technical Solutions

To solve the above-mentioned problems, the present disclosure provides a laundry treating apparatus including a cabinet including an opening defined in a front surface thereof, an inner casing disposed inside the cabinet to provide an accommodating space to accommodate clothes therein, and a door rotatably coupled to the cabinet to open and close the opening, wherein the door includes a door body coupled to the cabinet to shield the opening, wherein the door body provides a space where air introduced from the accommodating space flows, a door sealer coupled to a rear surface of the door body to block air in the accommodating space from leaking to the outside, an inlet disposed inwardly of the door sealer and extending through the rear surface of the door body to introduce air in the accommodating space into the door body, and a damper rotatably coupled to the inlet to selectively open and close the inlet.

The door may further include a chamber duct formed inside the door body and allowing air introduced via the inlet to flow, and the damper may be disposed inside the chamber duct.

The damper may include a flap rotatably coupled to the inlet to shield the inlet, and a damper sealer coupled to the flap and at least partially inserted into the inlet.

The damper sealer may include a sealer body disposed to surround at least a portion of the flap, a first sealer frame protruding from the sealer body in a ring shape and disposed outside the inlet, and a second sealer frame spaced rearwardly apart from the first sealer frame, protruding in a ring shape, and inserted into the inlet, and a width of the first sealer frame may be equal to or greater than a width of the inlet.

The door may include an inlet body protruding inward from one surface of the door body and forming a perimeter of the inlet, a plurality of inlet ribs disposed inside the inlet body and protruding inward from the one surface of the door body, and a plurality of door inlet holes defined between the plurality of inlet ribs, and the first sealer frame may shield a perimeter of the inlet body and the second sealer frame may shield the plurality of inlet ribs.

The plurality of inlet ribs may protrude inward from the one surface of the door body by a length smaller than a length of the inlet body.

A distance between the first sealer frame and the second sealer frame may correspond to a difference between a length of the inlet body protruding from the door body and a length of the inlet rib protruding from the one surface of the door body.

The flap may include a damper body disposed to be spaced forwardly apart from the inlet, and a shielding body protruding rearward from the damper body and at least partially inserted into the inlet.

The damper may further include a damper driver that is connected to the flap and pivots the flap to selectively open and close the inlet.

The damper driver may be fixed to the door body and connected to one side or a lower end of the flap.

The damper may further include an open/close sensor that senses whether the flap has completely shielded the inlet.

The open/close sensor may include a switch disposed such that at least a portion thereof is exposed into the door body, and a pressurizer that presses the switch when the flap pivots to close the inlet.

The door may include a support panel forming a front surface of the door body, and a coupling panel coupled to the support panel from the rear to form the inlet, and the chamber duct may be disposed between the support panel and the coupling panel.

The door may include a support chamber disposed to protrude from the support panel, and a coupling chamber disposed to protrude from the coupling panel and coupled with the support chamber to form the chamber duct.

The inlet may be disposed closer to an upper portion than to a lower portion of the door body.

The laundry treating apparatus may further include a hanger disposed in an upper portion of the inner casing to hang the clothes thereon, and the inlet may be disposed to face the hanger.

The door may further include an outlet duct disposed in a top surface of the door body to be in communication with the inside of the door body and guiding air introduced via the inlet to the outside of the door body.

The outlet duct may be inclined forward.

Alternatively, the present disclosure provides a laundry treating apparatus including a cabinet including an opening defined in a front surface thereof, an inner casing disposed inside the cabinet to provide an accommodating space to accommodate clothes therein, and a door rotatably coupled to the cabinet to open and close the opening, wherein the door includes a door body coupled to the cabinet to open and close the opening, a main panel coupled to the door body from the front and exposed to the outside of the cabinet, and a coupling portion that couples the door body with the main panel, wherein the door body includes a main surface to which the main panel is attached, and a bent surface extending rearward in a stepwise manner from at least one of both sides of the main surface, wherein the coupling portion is attached to the bent surface and has a thickness corresponding to a thickness of a step of the bent surface.

The coupling portion may include a coupling plate seated on the bent surface to correspond to the bent surface, and a magnet attached to the coupling plate and coupled with the main panel.

The door body may further include coupling hooks extending to protrude from the main surface toward the bent surface and arranged to be spaced apart from each other along a height direction of the main surface, and the coupling plate may be disposed between the coupling hooks and the bent surface.

The coupling plate may include a coupling surface seated on the bent surface, protruding surfaces formed as at least a portion of the coupling surface protrudes, and an accommodating surface disposed between the protruding surfaces to accommodate the coupling hook therein.

The coupling hook is disposed parallel to the main surface, so that the main panel may be seated.

The coupling plate may include a seating surface extending outward from the protruding surface and to which the magnet is attached.

The door body may further include an auxiliary surface that extends in a stepwise manner rearward from the bent surface, and at least a portion of the seating surface may overlap the auxiliary surface in a front and rear direction.

The coupling plate may further include a gripping surface bent from the seating surface toward the main panel to support the main panel.

The door body may include a rib hole extending through which at least a portion of the main surface, and a main frame forming a perimeter of the rib hole.

The door body may further include a reinforcing rib connecting at least portions of the main frame to each other.

The main frame may include first frames that form both side surfaces of the rib hole, and second frames that connect the first frames to each other and are disposed to be spaced apart from each other, and the reinforcing rib may be formed in an X-shape to connect the first frame and the second frame to each other.

The door body may further include a lower support surface that protrudes forward from a lower portion of the main surface and supports the coupling portion or a lower portion of the main panel.

The bent surface may include a first bent surface extending rearward in a stepwise manner from one side of the main surface and a second bent surface extending rearward in a stepwise manner from the other side of the main surface, the door body may include an auxiliary surface extending rearward in a stepwise manner from the first bent surface and a coupling auxiliary surface extending rearward in a stepwise manner from the second bent surface such that a width thereof is smaller than a width of the auxiliary surface, and the coupling plate may include a handle coupled to the first bent surface and at least partially overlapping the auxiliary surface in a front and rear direction and a side plate coupled to the second bent surface and at least partially overlapping the coupling auxiliary surface in the front and rear direction.

Alternatively, the present disclosure provides a laundry treating apparatus including a cabinet including an opening defined in a front surface thereof, an inner casing disposed inside the cabinet to provide an accommodating space to accommodate clothes therein, and a door rotatably coupled to the cabinet to open and close the opening, wherein the door includes a door body coupled to the cabinet to open and close the opening, a main panel coupled to the door body from the front and exposed to the outside of the cabinet, and a handle coupled to the door body and exposed to the outside of the door body, wherein the door body includes a main surface to which the main panel is attached, a bent surface extending rearward in a stepwise manner from one side of the main surface, and an auxiliary surface extending rearward in a stepwise manner from the bent surface, wherein the handle is coupled to the bent surface and at least partially overlaps the auxiliary surface in a front and rear direction.

The handle may include a coupling plate corresponding to the bent surface and seated on the bent surface.

The coupling plate may have a length corresponding to a length in a height direction of the bent surface and the auxiliary surface.

The coupling plate may include a coupling surface seated on the bent surface and a gripping surface bent forward and extending from the coupling surface, and a width of the coupling surface may be greater than a width of the gripping surface.

The gripping surface may support the main panel.

The door body may further include coupling hooks extending to protrude from the main surface toward the bent surface and arranged to be spaced apart from each other along a height direction of the main surface, and the coupling plate may be disposed between the coupling hooks and the bent surface.

The handle may further include a magnet attached to the coupling plate and coupled to the main panel, and the coupling hook and the magnet may be arranged in parallel with the main surface, so that the main panel may be seated.

The coupling plate may include protruding surfaces formed as at least a portion of the coupling surface protrudes forward, and an accommodating surface disposed between the protruding surfaces to accommodate at least some of the coupling hooks therein.

The accommodating surface may accommodate an entirety of the coupling hook therein, so that the coupling hook may be prevented from moving in the height direction.

The coupling plate may further include a fixing groove defined such that one side of the accommodating surface is depressed inward and into which the coupling hook is seated.

Alternatively, the present disclosure provides a laundry treating apparatus including a cabinet including an opening defined in a front surface thereof, an inner casing disposed inside the cabinet to provide a space to accommodate clothes therein, a door rotatably coupled to the cabinet to open and close the opening, and a machine room that is in communication with the inner casing and generates steam or hot air to be supplied to the inner casing, wherein the door includes a door body coupled to the cabinet to open and close the opening, a display installed on the door body to display information including a state of the machine room or the inner casing to the outside, an auxiliary panel coupled to the door body to shield the display, and a main panel coupled to the door body to be spaced apart from the auxiliary panel and exposed to the outside of the cabinet, wherein the door body includes a main surface to which the main panel is attached and an auxiliary surface extending rearward in a stepwise manner from one side of the main surface and where the display is installed, wherein the auxiliary panel is coupled to the auxiliary surface such that a height thereof corresponds to a height of the auxiliary surface.

The auxiliary surface may include an accommodating surface formed such that at least a portion thereof is recessed, and a contact surface disposed to surround the accommodating surface and to which the auxiliary panel is in contact.

The auxiliary surface may further include an adhesive attached to the accommodating surface for the auxiliary panel to be seated, and a thickness of the adhesive may correspond to a thickness of a step of the accommodating surface.

The door body may further include a bent surface extending rearward in a stepwise manner from the main surface and an extension surface disposed to connect the bent surface with the auxiliary surface, and the contact surface may be spaced apart from the extension surface.

The auxiliary panel may be formed such that a length thereof in a width direction decreases in a direction away from the contact surface.

The door body may further include an auxiliary rib formed in a grid shape on a rear surface of the auxiliary surface to reinforce a rigidity of the auxiliary surface.

The auxiliary panel may be disposed such that at least a portion thereof overlaps the main panel in a front and rear direction.

Advantageous Effects

The present disclosure may prevent the inside of the inner casing from being contaminated by allowing the inside of the inner casing to be in direct communication with the outside of the door to allow air to be discharged.

The present disclosure may allow the inside of the inner casing and the outside of the door to be in selective communication with each other.

The present disclosure may include the door that is integrally formed via the injection molding and thus is easy to manufacture, is thin, and is light in weight.

The present disclosure may, when the glass is attached to the door, prevents the glass from being removed or bending.

The present disclosure may, when the metal panel is attached to the door that is integrally formed via the injection molding, prevent the metal panel from being removed or bending.

The present disclosure may include the handle that may be easily gripped by the user and may create the aesthetic feeling.

BEST MODE

Figure 1:
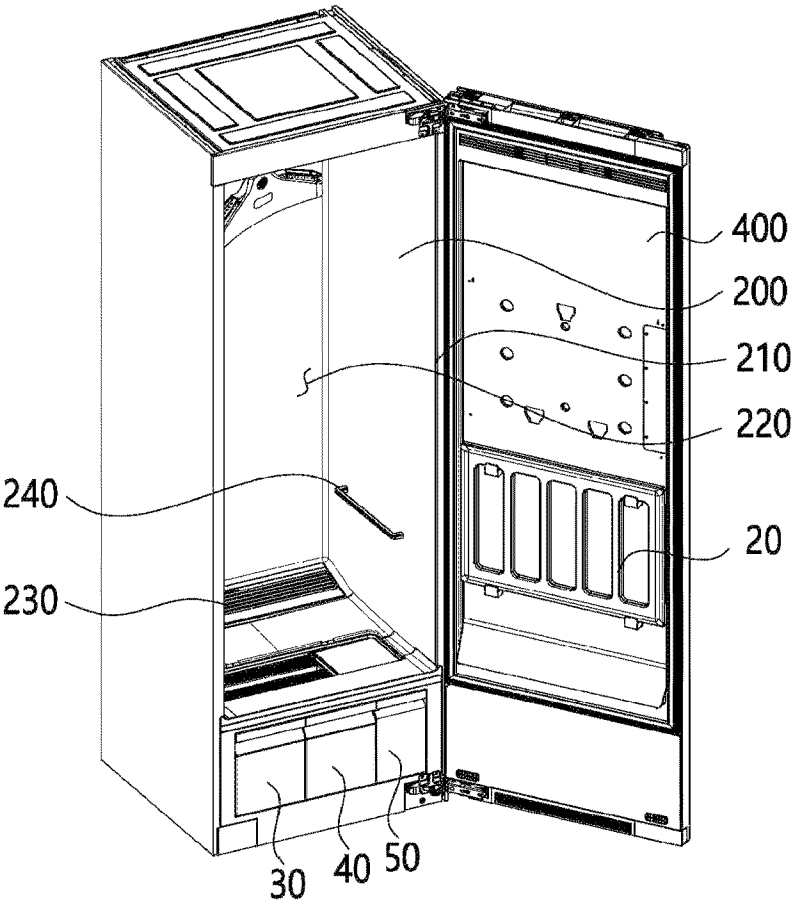
FIG. 1 shows an outer appearance of a laundry treating apparatus according to the present disclosure.
Figure 1:
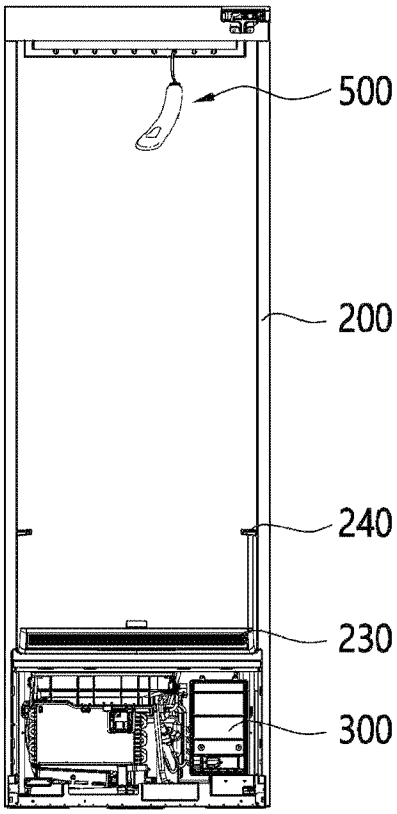

Hereinafter, with reference to the attached drawings, embodiments of the present disclosure will be described in detail such that those skilled in the art may easily practice them.

However, the present disclosure may be implemented in several different forms and may not be limited to the embodiments described herein. Further, to clearly illustrate the present disclosure in the drawings, parts unrelated to the description are omitted, and similar drawing numerals are assigned to similar parts throughout the present document.

Further, in the present document, when a component is referred to as being 'connected' to another component, it should be understood that the components may be directly connected to each other, but there may be another component therebetween. On the other hand, in the present document, when a component is referred to as being 'directly connected' to another component, it should be understood that there is no other component therebetween.

Additionally, the terms used herein are merely used to describe specific embodiments and are not intended to limit the present disclosure.

Further, as used herein, singular expressions may include plural expressions, unless the context clearly dictates otherwise.

In addition, in the present document, it should be understood that terms such as 'include' or 'have' are only intended to indicate the presence of features, numbers, steps, operations, components, parts, or combinations thereof described herein, and do not preclude the presence or addition of other features, numbers, steps, operations, components, parts, or combinations thereof.

Further, in the present document, the term 'and/or' includes a combination of a plurality of listed items or any of the plurality of listed items. As used herein, 'A or B' may include 'A', 'B', or 'both A and B'.

FIG. 1 shows an outer appearance of a laundry treating apparatus 1 according to the present disclosure.

Referring to (a) in FIG. 1, the laundry treating apparatus according to the present disclosure may include a cabinet 100 that forms an outer appearance of the apparatus, and may include a door 400 that is rotatably coupled to the cabinet 100.

Inside the cabinet 100, an inner casing 200 having an accommodating space 220 for accommodating clothes therein may be disposed. The inner casing 200 may have an opening 210 defined in a front surface thereof through which the clothes enter and exit, and the opening 210 may be shielded by the door 400.

The inner casing 200 may be made of a plastic resin material, and may be made of a reinforced plastic resin material that is not deformed by air at a temperature higher than a room temperature or heated air (hereinafter, referred to as hot air), steam, or moisture.

The inner casing 200 may have a height greater than a width. Accordingly, the clothes may be accommodated in the accommodating space 220 without being folded or wrinkled.

The inner casing 200 may further include a mounting rack 20 where small clothes such as shoes, a hat, and a doll may be mounted.

A rack support 240 that may support the mounting rack 20 may be disposed inside the inner casing 200.

In one example, the door 400 may include door bodies 410 and 420 forming a front surface of the cabinet 100, and a display D that displays information of the laundry treating apparatus and is installed on one side of the door bodies 410 and 420. A detailed structure of the door 400 will be described later.

In addition, the door 400 may further include a rack storage (not shown) where the mounting rack 20 may be stored.

When a user uses the mounting rack 20, the mounting rack 20 may be seated on the rack support 240, and when the user does not use the mounting rack 20, the mounting rack 20 may be stored by being hung in the rack storage defined in the door 400.

The laundry treating apparatus 1 according to the present disclosure may include a hanger assembly 500 to hang the clothes in the accommodating space 220 of the inner casing 200.

The hanger assembly 500 may include a hanger 510 disposed on a top surface of the inner casing 200 to hang the clothes.

When the clothes are hung on the hanger 510, the clothes may be placed while being suspended in air within the accommodating space 220.

In one example, the hanger assembly 500 may further include a presser assembly 520 that may be coupled to an inner surface of the door 400 to fix the clothes.

The hanger 510 may be formed in a bar shape disposed along a width direction of the inner casing 200 to support a clothes hanger on which the clothes are hung. Additionally, as shown, the hanger 510 may be formed in a shape of the clothes hanger such that the clothes may be directly hung thereon.

The laundry treating apparatus according to the present disclosure may further include a vibrator that may remove foreign substances such as fine dust attached to the clothes by vibrating the hanger 510.

The hanger assembly 500 may include the presser assembly 520 disposed on the door 400 to press and fix the clothes. The presser assembly 520 may include a support 522 that is fixed to the inner surface of the door 400 and supports one surface of the clothes, and a presser 521 that presses the clothes supported on the support 522.

The presser 521 may move toward or away from the support 522. For example, the presser 521 may be rotatably disposed on the support 522 or the inner surface of the door 400.

Accordingly, the presser 521 and the support 522 may press both surfaces of the clothes to remove wrinkles from the clothes and create intended creases.

Referring to (b) in FIG. 1, the laundry treating apparatus according to the present disclosure may have a machine room 300 in which various apparatuses that may supply one or more of hot air and steam to the accommodating space 220 or purify or dehumidify outdoor air of the cabinet 100 are installed.

The machine room 300 may be defined separately or partitioned from the inner casing 200, but may be in communication with the inner casing 200.

The machine room 300 may be defined under the inner casing 200. Accordingly, when hot air and steam with small specific gravities are supplied to the inner casing 200, hot air and steam may be naturally supplied to the clothes.

The machine room 300 may include a heat supply 340 that may supply hot air into the inner casing 200. The heat supply 340 may be formed as a heat pump system or as a heater that directly heats air with electrical energy.

When the heat supply 340 is formed as the heat pump system, the heat supply 340 may dehumidify and heat air discharged from the inner casing 200 again and supply air to the inner casing 200. A detailed structure thereof will be described later.

In one example, referring to (a) in FIG. 1 again, at a front side of the machine room 300, a water supply tank 30 that may supply water to the steam supply 800 and a water drainage tank 40 in which condensed water condensed in the heat supply 340 is collected may be disposed.

The water supply tank 30 and the water drainage tank 40 may be detachably disposed at the front side of the machine room 300. Accordingly, the laundry treating apparatus 1 according to the present disclosure may be freely installed regardless of a water source or a drain.

In one example, at the front side of the machine room 300, a drawer 50 that is extended and retracted in a front and rear direction and has a separate accommodating space may be further disposed. The drawer 50 may store a steam generator or an iron therein.

The machine room 300 may include a steam supply 800 that may supply steam into the inner casing 200. The steam supply 800 may directly supply steam into the inner casing 200.

To this end, the inner casing 200 may include a plurality of through-holes 230 that extend through one surface thereof to be in communication with the machine room 300.

Air from the accommodating space 220 may be supplied to the machine room 300 via the through-holes 230, and one or more of hot air and steam generated in the machine room 300 may be supplied to the accommodating space 220.

The through-holes 230 may include an inlet hole 231 extending through a bottom surface of the inner casing 200 and through which air inside the inner casing 200 is discharged to or sucked into the machine room 300, and an outlet hole 232 extending through the bottom surface of the inner casing 200 and through which hot air generated in the machine room 300 is discharged.

The outlet hole 232 may be defined in the bottom surface of the inner casing 200 biased toward a rear surface of the inner casing 200. For example, the outlet hole 232 may be defined between the bottom surface and the rear surface of the inner casing 200 at an angle to the ground and facing the hanger 510.

Additionally, the inlet hole 231 may be defined in the bottom surface of the inner casing 200 biased toward a front side. Accordingly, the inlet hole 231 may be defined to be spaced apart from the outlet hole 232.

The through-holes 230 may include a steam hole 233 through which steam generated by the steam supply 800 is supplied. The steam hole 233 may be defined on one side of the outlet hole 232.

Figure 2:
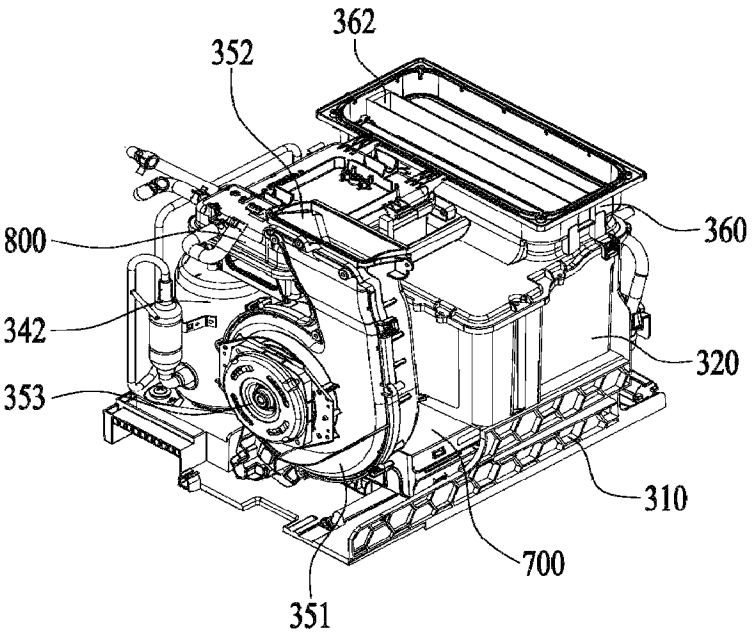
FIG. 2 shows a structure of a machine room of a laundry treating apparatus according to the present disclosure.
Figure 2:
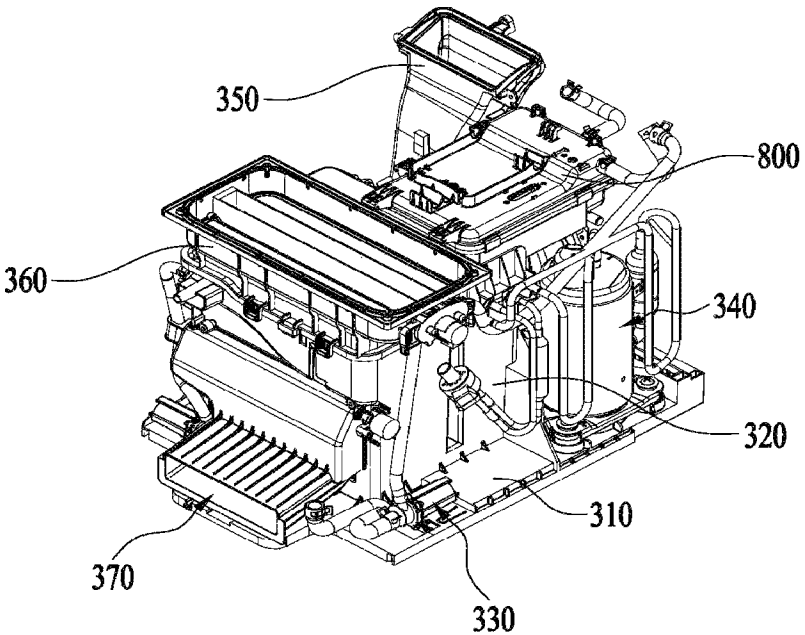

FIG. 2 shows a structure of a machine room of a laundry treating apparatus according to the present disclosure.

(a) in FIG. 2 is a front view of the machine room 300, and (b) in FIG. 2 is a rear view of the machine room 300.

Inside the machine room 300, components to supply hot air to a clothes treating space, to circulate air inside the clothes treating space, to supply steam to the clothes treating space, or to clean air outside the cabinet may be disposed.

The machine room 300 may include a base 310 on which a space to support various devices or to install the various devices is defined. The base 310 may provide an area where the various devices are installed.

The base 310 may be equipped with a circulating duct 320 through which air introduced from the inner casing 200 or outside the cabinet 100 flows.

The circulating duct 320 may be formed in a shape of a casing with an open top surface, and some components of the heat supply 340 may be installed inside the circulating duct 320.

When the heat supply 340 is formed as the heat pump system, the heat supply 340 may include, inside the circulating duct 320, heat exchangers 341 and 343, which will be described later, and a compressor 342 that supplies a high-temperature and high-pressure refrigerant to the heat exchanger.

The heat exchangers 341 and 343 may be accommodated inside the circulating duct 320 and cool and dehumidify air flowing through the circulating duct 320 or heat the air to generate hot air.

When the circulating duct 320 is constructed to suck air outside the cabinet 100, an outdoor air duct 370 that sucks outdoor air may be installed in front of the circulating duct 320.

The circulating duct 320 may be in communication with the outside air duct 370 and may selectively suck outdoor air.

The water supply tank and the water drainage tank may be detachably coupled to a front surface of the circulating duct 320. The water supply tank 30 and the water drainage tank 40 may be seated on the outdoor air duct 370.

The circulating duct 320 may be coupled to the base 310 or may be integrally formed with the base 310. For example, the base 310 and the circulating duct 320 may be manufactured via injection molding.

The machine room 300 may include a base cover 360 that allows the circulating duct 320 and the inlet hole 231 to be in communication with each other.

The base cover 360 may be coupled to an upper portion of the circulating duct 320 and may guide air sucked from the inlet hole 231 into the circulating duct 320.

The base cover 360 may block air inside the circulating duct 320 from being discharged to the outside by shielding a top surface of the circulating duct 320. A lower portion of the base cover 360 and the top surface of the circulating duct 320 may form one surface of a flow channel of the circulating duct 320.

The base cover 360 may include an inlet 362 that connects the inlet hole 231 and the circulating duct 320 to each other. The inlet 362 may be formed in a duct shape and may serve as an intake duct that delivers air inside the inner casing 200 to the circulating duct 320.

The machine room 300 may be installed with the steam supply 800 that generates steam by being connected to the water supply tank 30 to receive water, and supplies steam to the inner casing 200. The steam supply 800 may be seated on the base cover 360.

The steam supply 800 may be disposed at the rear of the inlet 362.

The machine room 300 may include a fan installation portion 350 disposed to allow the circulating duct 320 and the inner casing 200 to be in communication with each other. The fan installation portion 350 may include a blowing fan 353 that provides power for air inside the circulating duct 320 to flow in one direction, and a fan housing 351 that accommodates the blowing fan 353 therein and is coupled to or extends from the circulating duct 320.

The fan installation portion 350 may have a discharge duct 352 that allows the circulating duct 320 and the outlet hole 232 to be in communication with each other.

The discharge duct 352 may be constructed such that a cross-section thereof extends from the fan housing 351 toward the outlet hole 232 with an area size corresponding to that of the outlet hole 232.

As a result, air inside the inner casing 200 may be introduced via the base cover 360, pass through the circulating duct 320, and then be supplied back into the inner casing 200 via the fan installation portion 350.

Additionally, the base 310 may be installed with a controller or control panel C that controls the laundry treating apparatus according to the present disclosure.

In one example, the base 310 may have a compressor installation portion 313 where the compressor 342, which supplies the refrigerant to the heat exchangers 341 and 343, is installed. The compressor installation portion 313 may be disposed outside the circulating duct 320.

The base 310 may have a controller installation portion 312 that defines a space into which the controller C may be inserted under the circulating duct 320.

The controller C may control all electronically controlled components, such as the compressor 342, the steam supply 800, and the blowing fan 353.

Because the controller C is inserted into and supported in the base 310, vibration or impact applied to the controller C may be cushioned. Additionally, because the controller C is disposed close to all of the electronic components, occurrence of a control error such as noise may be minimized.

Additionally, the steam supply is disposed on the circulating duct 320, and the controller C is disposed under the circulating duct 320. Therefore, the circulating duct 320 may be formed in a shape of a straight duct between the steam supply 800 and the controller C. Therefore, an airflow resistance of air passing through the circulating duct 320 may be minimized.

The circulating duct 320, the outdoor air duct 370, the steam supply 800, the controller C, and the heat supply 340 may be formed on the base 310 in a module format.

As a result, the base 310 may be easily installed and maintained by being extended forward from and retracted rearward into the machine room 300.

Figure 3:
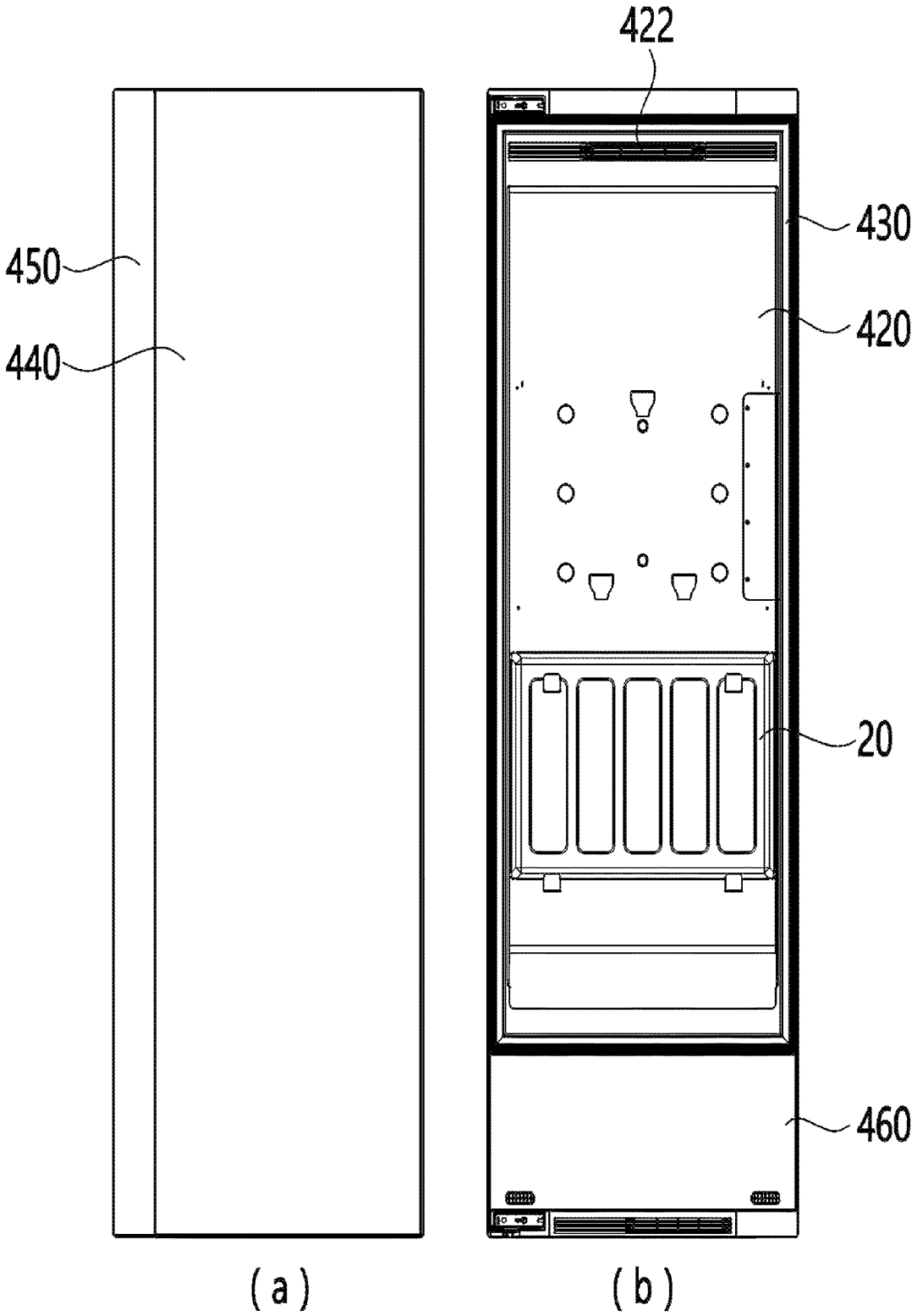
FIG. 3 shows an overall structure of a door of a laundry treating apparatus according to the present disclosure.
Figure 4:
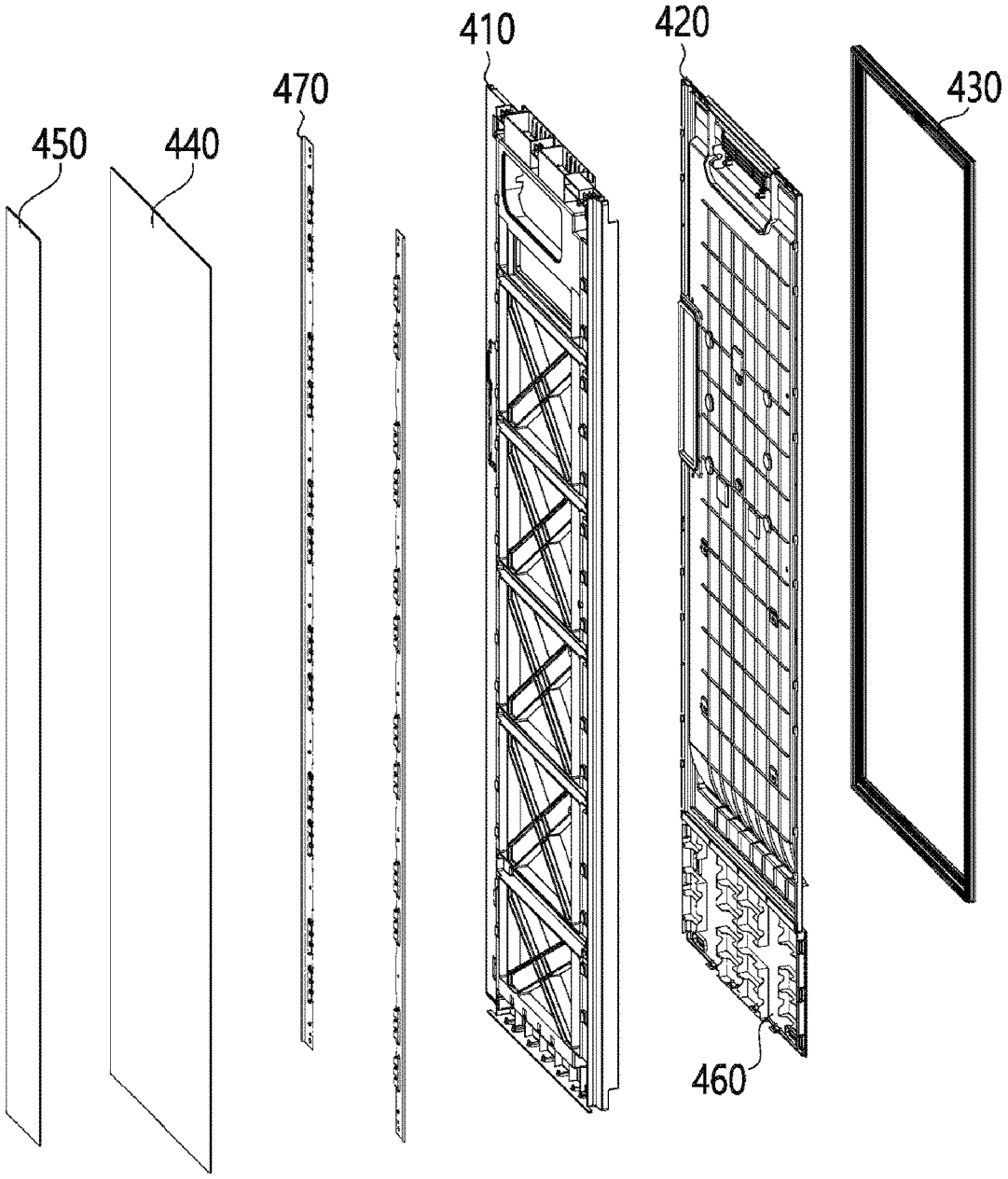
FIG. 4 shows an exploded perspective view of the door.

FIG. 3 shows an overall structure of a door of a laundry treating apparatus according to the present disclosure, and FIG. 4 shows an exploded perspective view of the door. (a) in FIG. 3 is a front view of the door 400, and (b) in FIG. 3 is a rear view of the door 400.

Referring to FIGS. 3 and 4, the overall structure of the door 400 will be described.

The door 400 may include a main panel 440 and an auxiliary panel 450, a door body 410, and a door sealer 430 sequentially from the front.

The door 400 may include the door body 410 that is coupled to the cabinet 100 and opens and closes the opening 210. The door body 410 has advantages of being easy to be manufactured, being thin, and being light in weight because it is integrally formed via injection molding.

The door body 410 may include a support panel 4101 to which the main panel 440 and the auxiliary panel 450 are coupled, and a coupling panel 420 and a machine room panel 460 that are disposed at the rear of the support panel 4101 to form a rear surface of the door body 410. The coupling panel 420 may be disposed upwardly of the machine room panel 460 and have a height greater than that of the machine room panel 460. Detailed structures of the support panel 4101 and the coupling panel 420 will be described later.

The machine room panel 460 may be disposed under the door body 410 such that the height thereof corresponds to that of the machine room 300. The machine room panel 460 may be disposed to face the water supply tank 30, the water drainage tank 40, and the drawer 50.

Referring to (a) in FIG. 3 and FIG. 4, the main panel 440 exposed to the outside of the cabinet 100, and the auxiliary panel 450 spaced apart from the main panel 440 and shielding the display D may be disposed on a front surface of the door body 410.

The auxiliary panel 450 may be disposed to form a step from the main panel 440 in a rearward direction of the cabinet 100. The step may be formed by a structure of the door body 410. A detailed structure thereof will be described later.

In one example, at least a portion of the auxiliary panel 450 may be disposed to overlap the main panel 440 in the front and rear direction. As a result, the step may function as a handle.

The auxiliary panel 450 may be made of a material different from that of the main panel 440 or may have a color different from that of the main panel 440. Additionally, the auxiliary panel 450 may be made of a translucent material (e.g., a glass material, an acrylic material, and the like) through which light emitted from the display D may be transmitted.

Referring to (b) in FIG. 3 and FIG. 4, the door body 410 may be coupled with the door sealer 430 that is coupled to a rear surface of the door body 410, that is, the coupling panel, to prevent air in the accommodating space 220 from leaking to the outside of the inner casing 200. Additionally, the door body 410 may include an inlet 422 formed on the coupling panel 420 to allow air from the accommodating space 220 to flow into the door body 410.

Hot air or steam generated in the machine room 300 may flow through the accommodating space 220, then flow into the door body 410 via the inlet 422, and be discharged via the door 400. Therefore, it is preferable that the inlet 422 is disposed to be accommodated inside the door sealer 430. A detailed structure thereof will be described later. As a result, the inside of the inner casing 200 and the door 400 may be in direct communication with each other to adjust a humidity, a temperature, or the like inside the inner casing 200 and prevent the inside of the inner casing 200 from being contaminated.

In one example, the door body 410 may further include the rack storage (not shown) to store the mounting rack 20 in the rear surface thereof. Accordingly, when the user uses the mounting rack 20, the mounting rack 20 may be seated on the rack support 240, and when the user does not use the mounting rack 20, the mounting rack 20 may be stored by being hung in the rack storage defined in the door 400.

Figure 5:
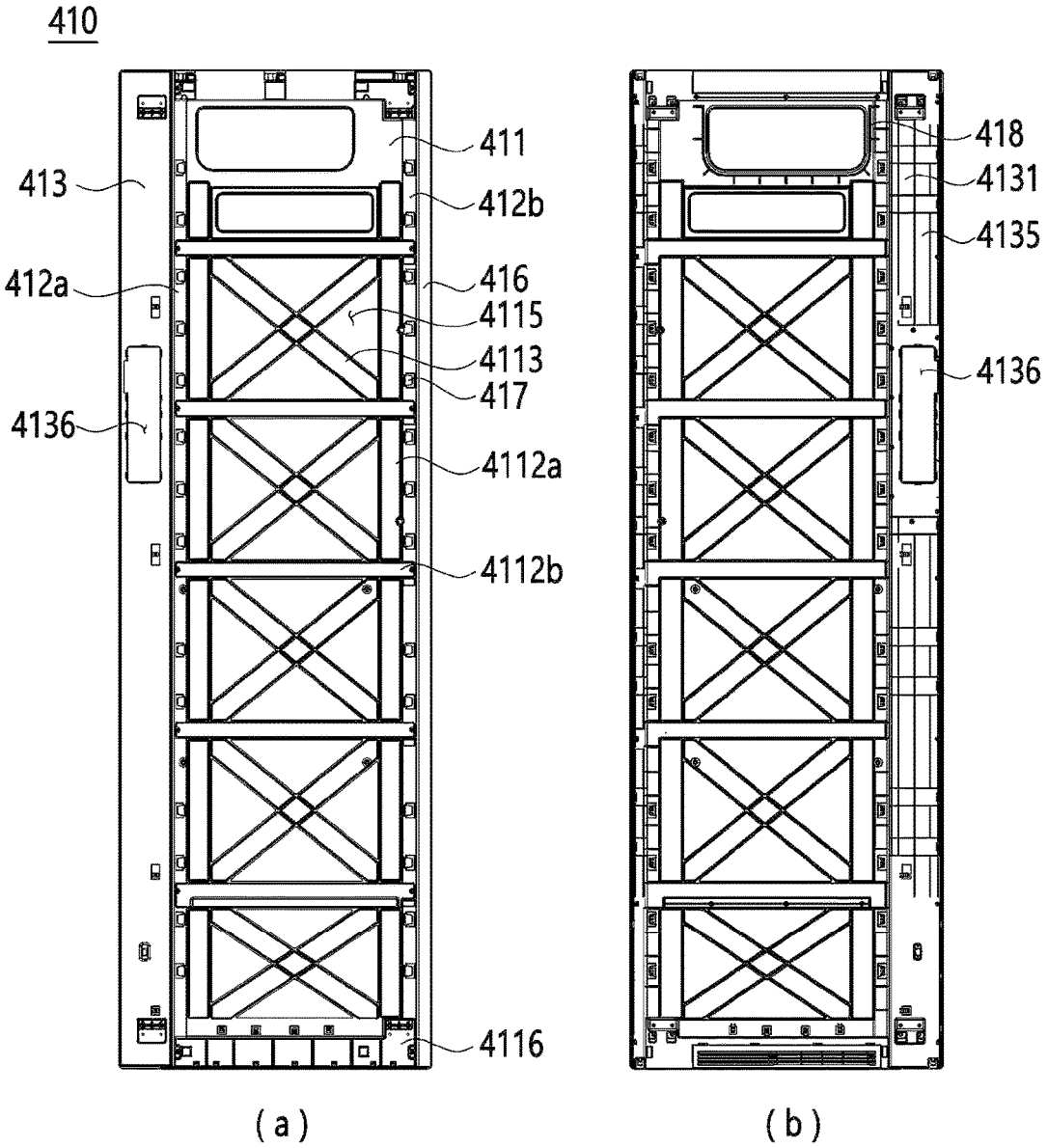
FIG. 5 shows a structure of a support panel of the door.
Figure 6:
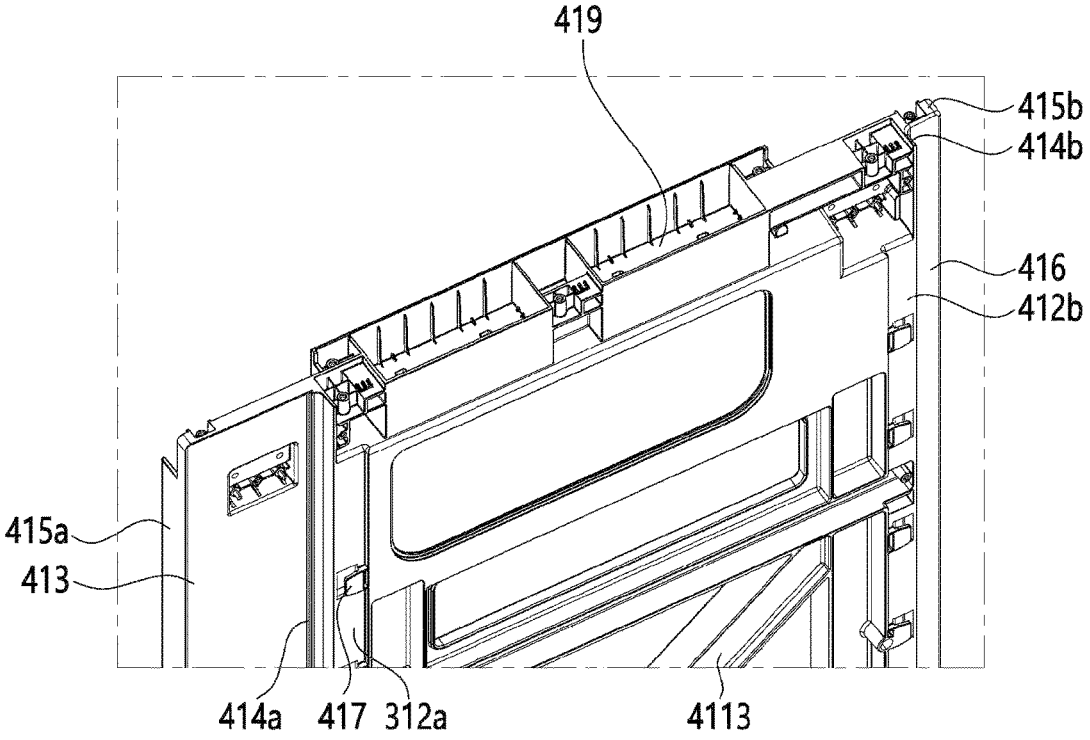
FIG. 6 is an enlarged view of a front surface of the support panel.

FIG. 5 shows a structure of a support panel of the door, and FIG. 6 is an enlarged view of a front surface of the support panel.

(a) in FIG. 5 shows a front surface of the support panel 4101, and (b) in FIG. 5 shows a rear surface of the support panel 4101.

Referring to (a) in FIG. 5 and FIG. 6, the door body 410 may include the support panel 4101 coupled to the cabinet 100 to open and close the opening 210 and to which the main panel 440 and the auxiliary panel 450 are attached.

The support panel 4101 may include a main surface 411 to which the main panel 440 is attached, a bent surface 412 extending rearward in a stepwise manner from at least one of both sides of the main surface, and an auxiliary surface 413 extending rearward in a stepwise manner from the bent surface.

Specifically, because the door body 410 is formed integrally via plastic injection molding, to attach the main panel 440 made of metal to the main surface 411, a separate structure such as a magnet is needed to couple the main panel 440. To this end, the door body 410 may include a coupling portion 470 that couples the door body 410 and the main panel 440 to each other. A detailed structure of the coupling portion 470 will be described later.

In one example, when the main panel 440 is attached to the main surface 411, the main panel 440 made of the metal may be bent or separated from the main surface 411. To solve such problem, the door body 410 may include a rib hole 4115 extending through at least a portion of the main surface 411, and a main frame 4112 forming a perimeter of the rib hole 4115.

Additionally, the door body 410 may further include a reinforcing rib 4113 that connects at least portions of the main frame 4112 to each other. The reinforcing rib 4113 may be disposed to cross the rib hole 4115.

The main frame 4112 may include first frames 4112*a* that form both side surfaces of the rib hole 4115, respectively, and second frames 4112*b* that connect the first frames 4112*a* to each other in a width direction and are spaced apart from each other. The reinforcing rib 4113 may be formed in an X shape, connect the first frame 4112*a* and the second frame 4112*b* to each other, and cross the rib hole 4115.

As a result, not only may a rigidity of the main panel 440 be strengthened to prevent the main panel 440 from being bent or separated from the main surface 411, but also a weight of the door body 410 may be reduced to allow the user to open and close the door 400 easily.

In one example, the bent surface 412 may be disposed on at least one of the both side surfaces of the main surface 411. The bent surface 412 may include a first bent surface 412*a* extending rearward in a stepwise manner from one side of the main surface 411, and a second bent surface 412*b* extending rearward in a stepwise manner from the other side of the main surface 411. Because the first bent surface 412*a* and the second bent surface 412*b* have the same structure with only different widths, the bent surface 412 will be described below based on the first bent surface 412*a*.

In one example, the auxiliary surface 413 may extend rearward in a stepwise manner from the first bent surface 412*a*. Additionally, on an opposite side of the auxiliary surface 413, a coupling auxiliary surface 416 that extends rearward in a stepwise manner from the second bent surface 412*b* such that a width thereof is smaller than that of the auxiliary surface. The auxiliary surface 413 and the combined auxiliary surface 416 may have the different widths and may differ from each other in the presence of the display D, but may have the same structure.

The door body 410 may further include a first support side surface 415*a* that extends rearward from the auxiliary surface 413 and connects the support panel 4101 and the coupling panel 420 to each other. Additionally, the door body 410 may further include a second support side surface 415*b* that extends rearward from the coupling auxiliary surface 416 and connects the support panel 4101 and the coupling panel 420 to each other. The first support side surface 415*a* and the second support side surface 415*b* have the same structure except that widths and positions thereof are different from each other.

In one example, the auxiliary surface 413 may include a display hole 4136 extending through a portion of the auxiliary surface 413 and through which the display D may be installed. The display hole 4136 is preferably defined with an area size greater than that of the display D. Additionally, the coupling panel 420 may have a display installation hole 423 to face the display hole 4136. The display installation hole 423 may be defined with an area size greater than that of the display hole 4136.

The display D may be accommodated in the display hole 4136 and installed at a vertical level, spaced apart from a bottom surface of the auxiliary surface 413 in a height direction, aligned with a user's eye level. Accordingly, the user may recognize information including a state of the inner casing 200 or the machine room 300 via the display D.

The present disclosure provides a laundry treating apparatus, wherein the auxiliary panel 450 is coupled to the auxiliary surface 413 to correspond to a height of the auxiliary surface 413. The auxiliary panel 450 may be made of a material such as a transparent or translucent glass or acrylic material. Therefore, when the auxiliary panel 450 is attached to the auxiliary surface 413, the auxiliary panel 450 may be bent or removed. To prevent such problem, provided is the laundry treating apparatus in which the auxiliary panel 450 may be attached to the auxiliary surface 413 so as not to be bent or removed.

Specifically, referring to FIG. 6, the auxiliary surface 413 may include an accommodating surface 4133 that is at least partially recessed, and a contact surface 4132 that is disposed to surround the accommodating surface 4133 and is in contact with the auxiliary panel 450.

The auxiliary surface 413 may further include an adhesive 4134 attached to the accommodating surface 4133. The adhesive 4134 may be made of any material that attaches the auxiliary panel 450 to the auxiliary surface 413, and may be made of an adhesive that may strongly adhere a plastic material, a glass material, and the like. A thickness of the adhesive 4134 may correspond to that of a step between the accommodating surface 4133 and the contact surface 4132. As a result, the auxiliary panel 450 may be attached to the auxiliary surface 413 without protruding.

The contact surface 4132 may be formed in a frame shape to correspond to a perimeter of the auxiliary panel 450. The accommodating surface 4133 may be surrounded by the contact surface 4132 and may accommodate the adhesive 4134.

In one example, the support panel 4101 may further include an extension surface 414 disposed to connect the bent surface 412 with the auxiliary surface 413. The extension surface 414 may include a first extension surface 414*a* that connects the first bent surface 412*a* with the auxiliary surface 413, and a second extension surface 414*b* that connects the second bent surface 412*b* with the coupling auxiliary surface 416 on an opposite side of the first extension surface 414*a*. Because the first extension surface 414*a* and the second extension surface 414*b* have the same structure except that widths and positions thereof are different from each other, the extension surface 414 will be described below based on the first extension surface 414*a*.

The auxiliary panel 450 or the contact surface 4132 may be disposed to be spaced apart from the extension surface 414. As a result, an assembly tolerance of the auxiliary panel 450 may be considered and vibration or impact transmitted from the door body 410 may be prevented from being transmitted to the auxiliary panel 450.

The auxiliary panel 450 may be formed such that a length thereof in the width direction decreases in a direction away from the contact surface 4132. That is, each corner of the auxiliary panel 450 may be chamfered to form a round shape. As a result, damage to a user's body may be prevented and the auxiliary panel 450 may be easily attached. Additionally, the auxiliary panel 450 may be attached to the auxiliary surface 413 by overcoming the assembly tolerance of the auxiliary panel 450.

In one example, the door body 410 may further include a lower support surface 4116 disposed at a lower portion of the main surface 411 so as to protrude forward and supporting the coupling portion 470. As a result, the main panel 440 may be supported by the lower support surface 4116 and coupled in a manner in which an upper portion thereof pivots, making manufacturing easier.

Additionally, in the door body 410, a structure for fixing a wire connecting the display D with the machine room 300 may be integrally formed with a lower portion of the support panel 4101. As a result, there is no need to manufacture a separate structure for fixing the wire or the like on the door body 410, thereby simplifying a process and reducing a cost.

In one example, referring again to (b) in FIG. 5 and FIG. 11, the door body 410 may further include an auxiliary rib 4135 that reinforces a rigidity of the auxiliary surface 413 by being formed in a grid shape on an auxiliary rear surface 4131 forming a rear surface of the auxiliary surface 413. A density of the auxiliary rib 4135 may be higher than that of the reinforcing rib 4113 disposed on the main surface 411. As a result, the auxiliary surface 413 may be prevented from bending even when the auxiliary panel 450 is attached thereto.

Figure 7:
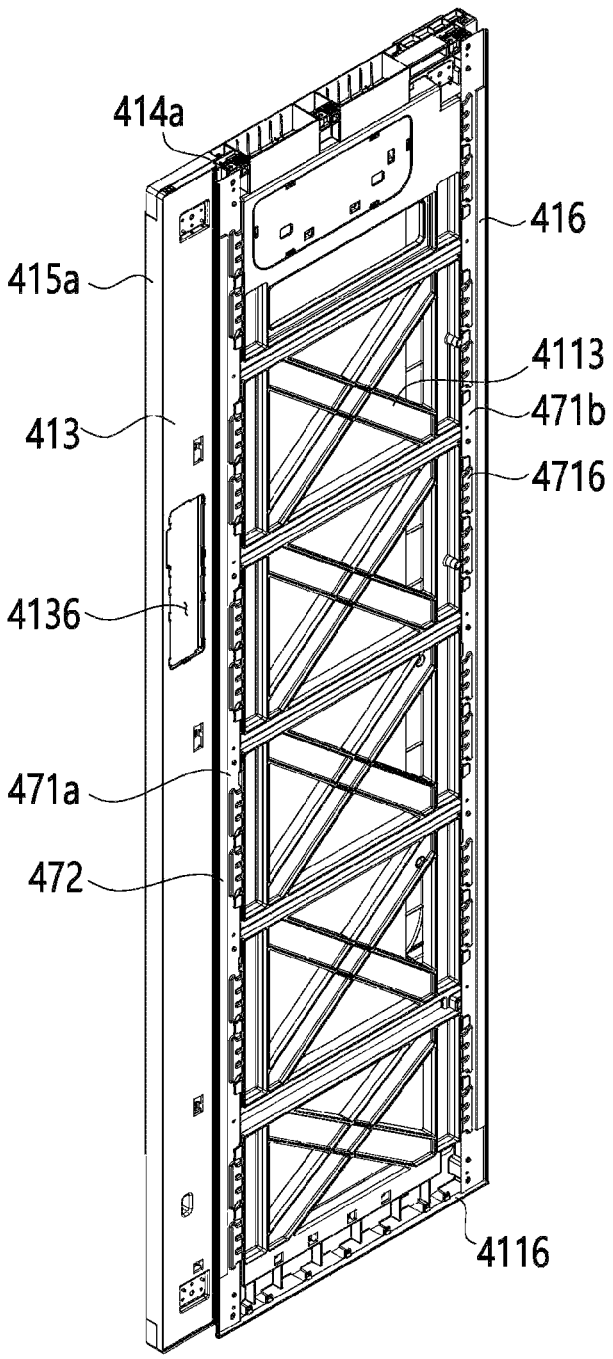
FIG. 7 is a front view of a support panel to which a coupling portion is coupled.
Figure 8:
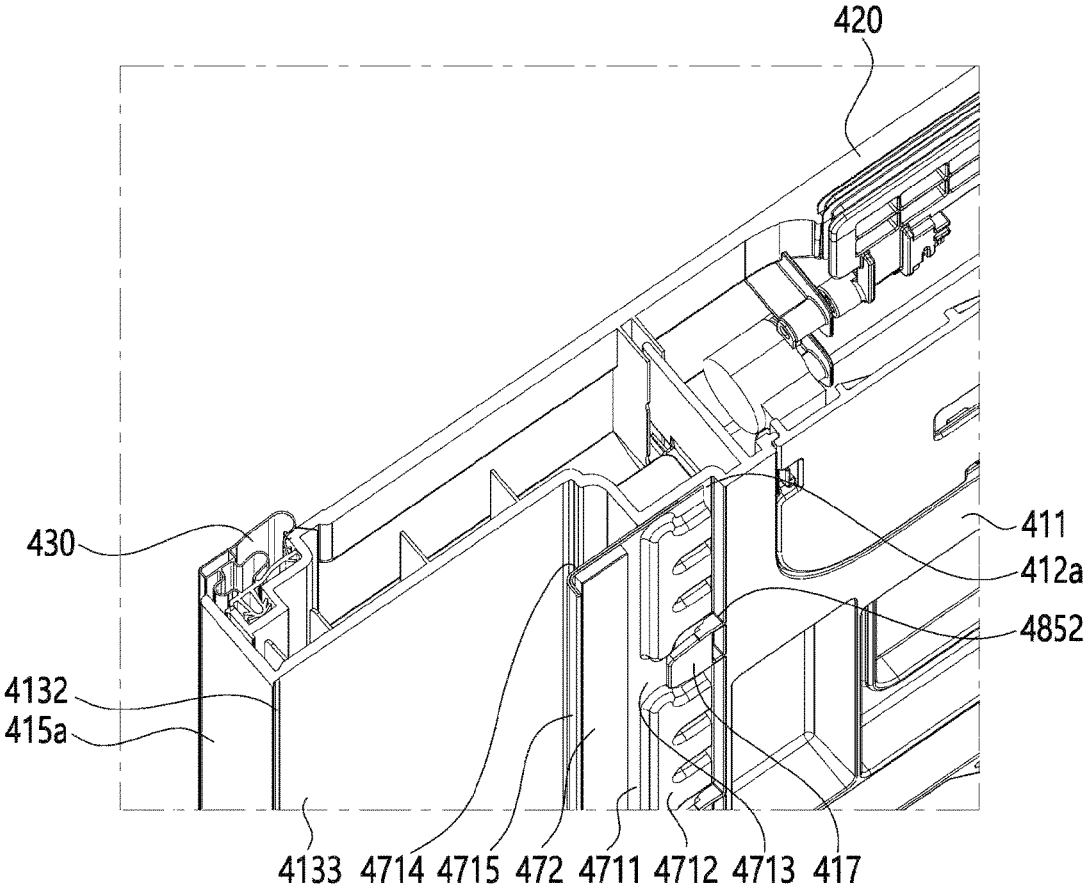
FIG. 8 is an enlarged view of the coupling portion.

FIG. 7 is a front view of a support panel to which a coupling portion is coupled, and FIG. 8 is an enlarged view of the coupling portion.

The present disclosure may include the cabinet 100 having the opening 210 defined in the front surface thereof, the inner casing 200 disposed inside the cabinet 100 to provide the space for accommodating the clothes, and the door 400 rotatably coupled to the cabinet 100 to open and close the opening 210. The door 400 may include the door body 410 coupled to the cabinet 100 to open and close the opening 210, a main panel 440 coupled to the door body 410 from the front and exposed to the outside of the cabinet 100, and the coupling portion 470 that couples the door body 410 with the main panel 440. The door body 410 may include the main surface 411 to which the main panel 440 is attached, and the bent surface 412 that extends rearward in a stepwise manner from at least one of both sides of the main surface 411. Further, the coupling portion 470 may be attached to the bent surface 412 and may have a thickness corresponding to that of a step of the bent surface 412.

With reference to FIGS. 7 and 8, the coupling portion 470 that attaches the main panel 440 to the support panel 4101 will be described in detail.

The coupling portion 470 may include a coupling plate 471 seated on the bent surface 412, and a magnet 472 attached to the coupling plate 471 and to which the main panel 440 is coupled. The coupling plate 471 and the magnet 472 may extend along a height direction of the main surface 411 such that a height thereof corresponds to that of the main surface 411.

In this regard, a thickness of the coupling portion 470 including the coupling plate 471 and the magnet 472 may correspond to that of the step of the bent surface 412. Alternatively, when only the magnet 472 is attached to the bent surface 412, a thickness of the magnet 472 may correspond to that of the step of the bent surface 412. As a result, the main panel 440 is seated and supported on both the main surface 411 and the coupling portion 470, thereby improving a coupling force between the main panel 440 and the door body 410 and enabling more stable coupling.

The coupling plate 471 may be seated on both sides of the bent surface 412, and may include a handle 471*a* seated on the first bent surface 412*a* and a side plate 471*b* seated on the second bent surface 412*b*. The handle 471*a* and the side plate 471*b* may be disposed to be symmetrical with respect to a center of the door body 410 in the width direction. As a result, the coupling plate 471 may stably seat the main panel 440 on both sides of the main surface 411.

The side plate 471*b* may be disposed to at least partially overlap the coupling auxiliary surface 416 in a front and rear direction.

In one example, the door body 410 may further include coupling hooks 417 that extend to protrude from the main surface 411 toward the bent surface 412 and are disposed to be spaced apart from each other along the height direction of the main surface 411. The plurality of coupling hooks 417 may be disposed at both sides of the main surface 411 and disposed to be spaced apart from each other in the height direction.

The coupling plate 471 may be coupled to the coupling hook 417 and disposed between the coupling hook 417 and the bent surface 412.

The coupling hook 417 may be disposed parallel to the main surface 411, so that the main panel 440 may be seated thereon. That is, the coupling hook 417 may be disposed to be spaced apart from the bent surface 412 by the step of the bent surface 412. A surface of the coupling hook 417 facing the main panel 440 may be flat such that the main panel 440 may be seated thereon. As a result, an area on which the main panel 440 is seated when being attached to the door body 410 is expanded, so that the main panel 440 may be stably attached to the door body 410. Additionally, when an impact is applied to the main panel 440, the coupling hook 417 may absorb the impact, thereby improving stability.

The coupling plate 471 may include a coupling surface 4711 seated on the bent surface 412, protruding surfaces 4712 formed as at least a portion of the coupling surface 4711 protrudes and spaced apart from each other in the height direction, and an accommodating surface 4713 disposed between the protruding surfaces 4712 to accommodate at least some of the coupling hooks 417 therein. The accommodating surface 4713 may also include a plurality of accommodating surfaces that are spaced apart from each other in the height direction.

When the coupling plate 471 is coupled to the coupling hook 417, the accommodating surface 4713 may be coupled by sliding to a space between the coupling hook 417 and the bent surface 412. As a result, the coupling plate 471 may be prevented from pivoting outwardly of the main surface 411 and being deviated from the main surface 411. In this regard, the protruding surfaces 4712 may support upper and lower ends of the coupling hook 417 to prevent the coupling hook 417 from moving in the height direction.

Alternatively, the coupling plate 471 may further include a fixing groove 4716 defined such that one side of the accommodating surface 4713 is recessed inward and in which the coupling hook 417 is seated. The fixing groove 4716 may support the upper and lower ends of the coupling hook 417 to prevent the coupling hook 417 from moving in the height direction.

Alternatively, the coupling plate 471 may include a coupling hole 4717 into which the coupling hook 417 is inserted. The number of coupling holes 4717 may correspond to the number of coupling hooks 417 and the coupling holes 4717 may be defined to be spaced apart from each other in a height direction of the coupling plate 471. When the coupling hook 417 is inserted into the coupling hole 4717, the coupling plate 471 may slide toward the main surface 411 and be coupled to the bent surface 412.

In this regard, the coupling hook 417 may be spaced apart from the main surface 411 and disposed on the bent surface 412. The coupling hook 417 may include a hook protrusion 4171 that protrudes forward from the bent surface 412 and is inserted into the coupling plate 471, and a hook extension 4172 that extends from the protrusion and supports the coupling plate 471 into which the protrusion is inserted.

A length in the height direction of the coupling hole 4717 may correspond to a thickness in the height direction of the hook protrusion 4171. As a result, upper and lower ends of the hook protrusion 4171 are supported by the coupling hole 4717, thereby preventing the coupling hook 417 from moving in the height direction. Additionally, a length in the width direction of the coupling hole 4717 may be greater than a thickness in the width direction of the hook protrusion 4171. As a result, the hook protrusion 4171 may slide inside the coupling hole 4717, so that the coupling plate 471 may be coupled to or separated from the coupling hook 417.

The door body 410 may further include a fastener 490 that couples the coupling plate 471 with the bent surface 412. The fastener 490 may be formed as a structure that may couple the coupling plate 471 and the bent surface 412 to each other, such as a bolt and a nut. The fastener 490 may prevent the coupling plate 471 from being deviated from the bent surface 412.

In one example, the protruding surface 4712 may also be disposed parallel to the main surface 411, so that the main panel 440 may be seated thereon. That is, the protruding surface 4712 may protrude from the coupling surface 4711 by the step of the bent surface 412. A surface of the protruding surface 4712 facing the main panel 440 may be flat such that the main panel 440 may be seated. As a result, not only is a rigidity of the coupling plate 471 reinforced by the protruding surface 4712 to prevent the bending, but also the area where the main panel 440 is seated when being attached to the door body 410 is expanded, so that the main panel 440 may be stably attached to the door body 410.

The coupling plate 471 may further include a seating surface 4714 that is disposed outwardly of the protruding surface 4712, extends outwardly of the protruding surface 4712, and is attached to the magnet 472. Accordingly, the magnet 472 may support a surface close to a corner of the main panel 440.

At least a portion of the seating surface 4714 may overlap the auxiliary surface 413 in the front and rear direction. In this regard, the coupling plate 471 may further include a gripping surface 4715 that is bent from the seating surface 4714 toward the main panel 440 and supports the main panel 440.

The coupling plate 471 may connect the bent surface 412 with the main panel 440. For example, at least a portion of the coupling plate 471 may be seated on the bent surface 412, and at least a different portion thereof may be in contact with the main panel 440. In particular, the handle 471*a* may partially overlap the auxiliary panel 450 in the front and rear direction, and may connect the bent surface 412 with the main panel 440, so that the user may easily grip the handle 471*a* and damage to the auxiliary panel 450 may be prevented when the user opens the door 400.

Figure 9:
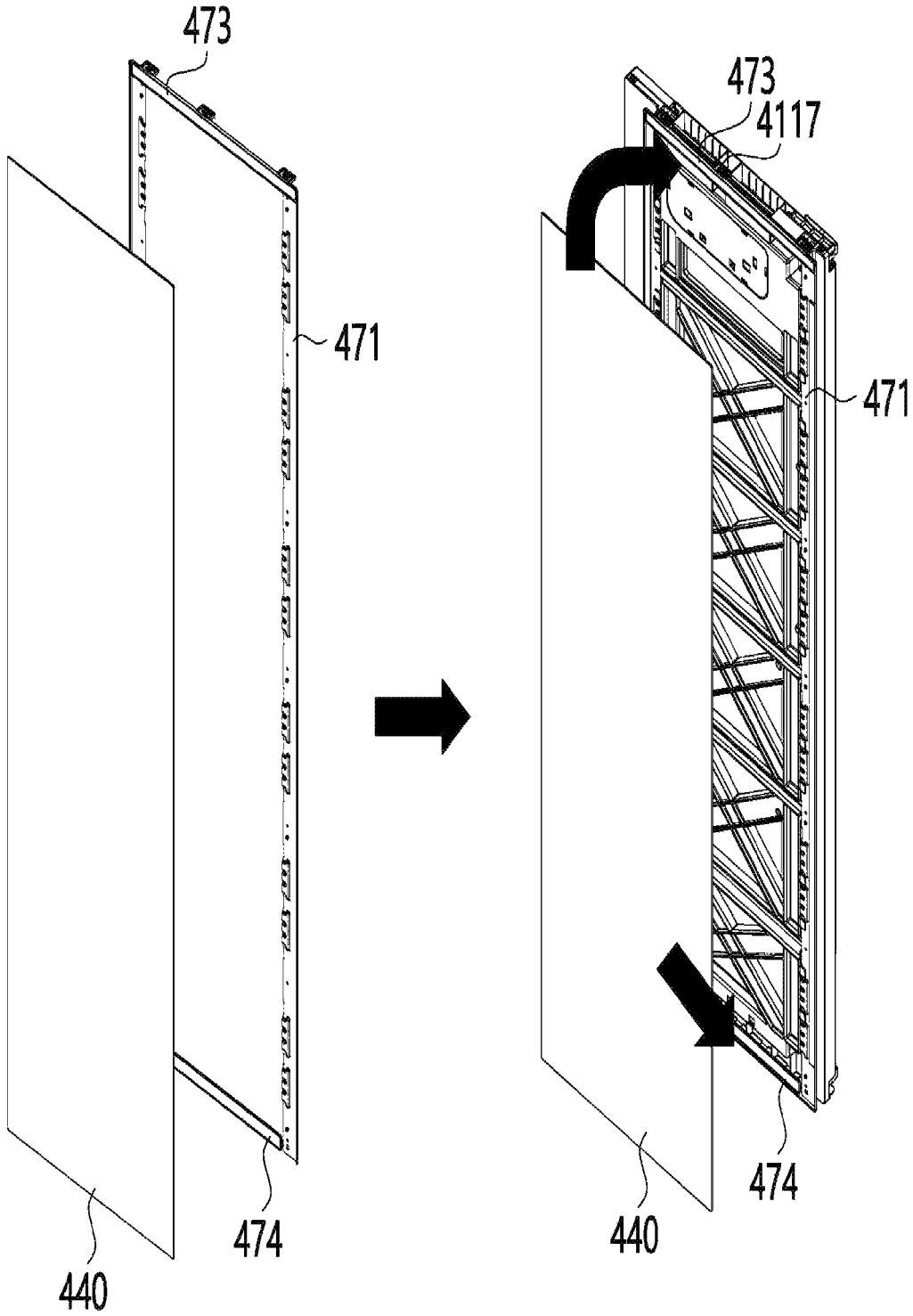
FIG. 9 shows a structure of the coupling portion.

FIG. 9 shows a structure of the coupling portion.

As described above, the main panel 440 may be coupled to the door body 410, and the door 400 may include the coupling portion 470 that couples the main panel 440 to the door body 410. The main panel 440 may be disposed to be pivotable at the lower portion of the door body 410 and coupled to an upper portion of the door body 410. As a result, the main panel 440 may be easily removed or coupled, and thus, may be easily replaced.

The coupling portion 470 may include the coupling plate 471 coupled to both sides of the door body 410, a lower coupling portion 474 coupled to the lower portion of the door body 410, and an upper coupling portion 473 coupled to the upper portion of the door body 410.

The coupling plate 471 may be seated on both sides of the bent surface 412 and may include the handle 471*a* seated on the first bent surface 412*a* and the side plate 471*b* seated on the second bent surface 412*b*.

The coupling plate 471 may be coupled to the main panel 440 by the magnet 472, and the lower coupling portion 474 and the upper coupling portion 473 may be attached to a rear surface of the main panel 440 with an adhesive.

In one example, the door body 410 may include the lower support surface 4116 disposed at the lower portion of the main surface 411 to support the lower coupling portion 474, and an upper fastener 4117 disposed at an upper portion of the main surface 411 and coupled with the upper coupling portion 473.

Figure 19:
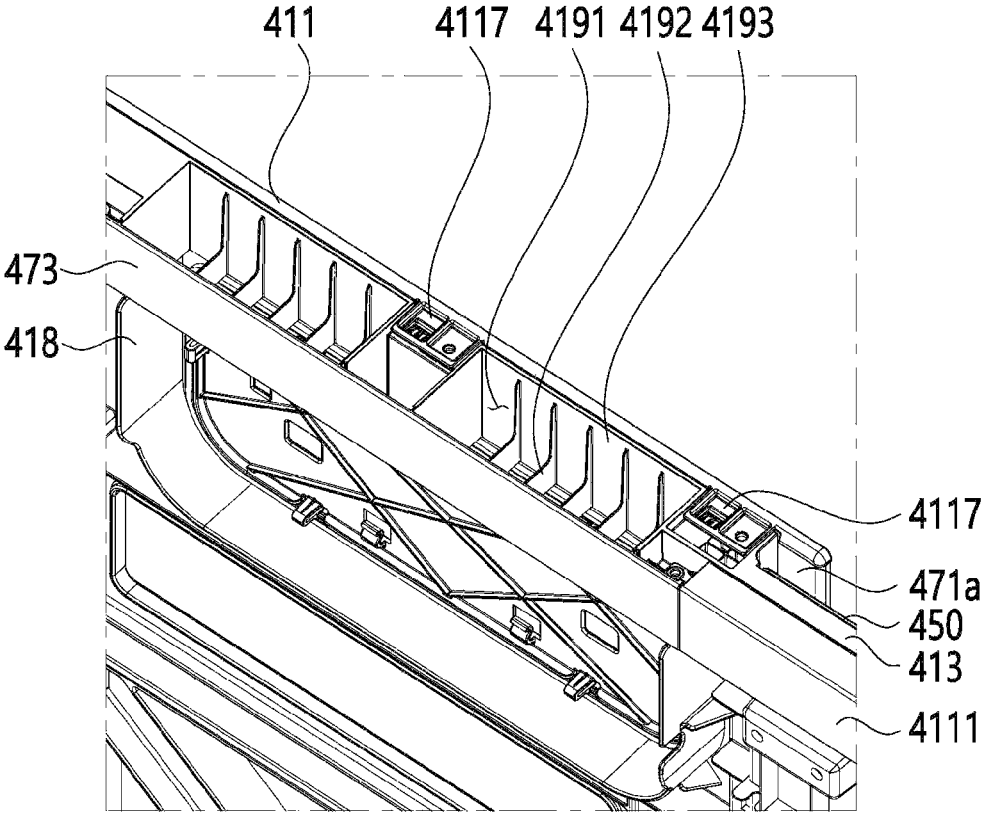
FIG. 19 is a top perspective view of the door.

Referring to FIGS. 9 and 19, the upper fastener 4117 may include a plurality of upper fasteners disposed at the upper portion of the door body 410 to be spaced apart from each other. The upper fasteners 4117 may be disposed to be spaced apart from each other in an outlet duct 419, which will be described later.

Accordingly, the main panel 440 may be fastened by pivoting at the upper side of the door body 410 while being supported on the lower support surface 4116 of the door body 410, so that the main panel 440 may be easily coupled to the door body 410.

Figure 10:
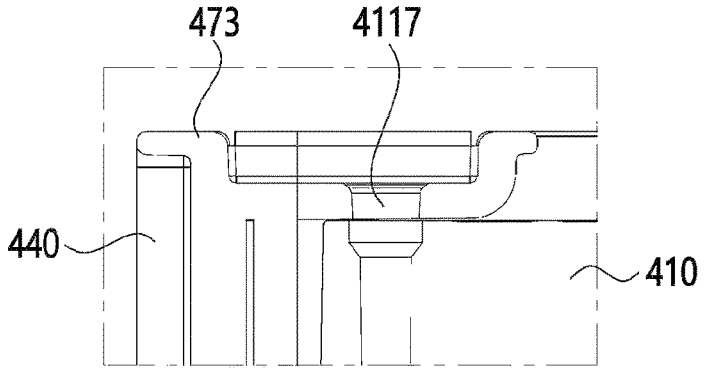
FIG. 10 shows a cross-section of the coupling portion.
Figure 10:
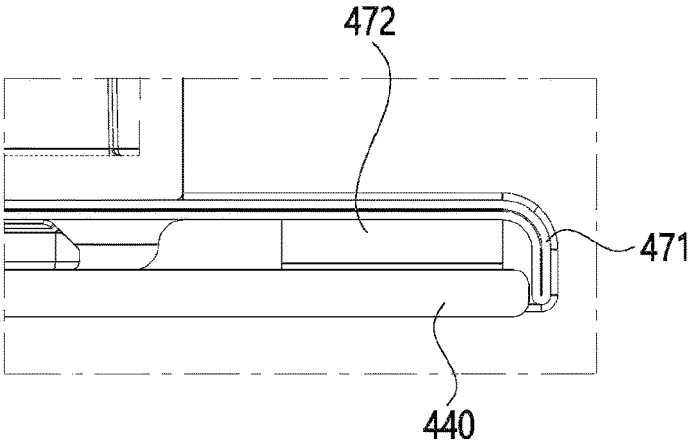
Figure 10:
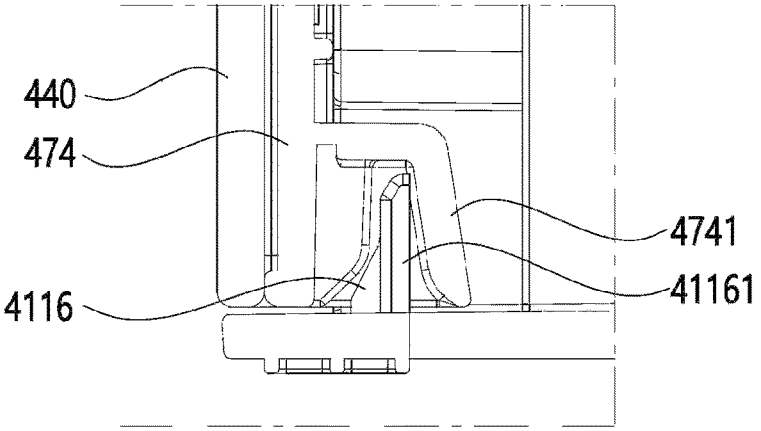

FIG. 10 shows a cross-section of the coupling portion. Referring to FIG. 10, a structure in which the main panel is fastened to the door body will be described.

(a) in FIG. 10 shows a cross-section of an upper portion of the door 400. When the lower coupling portion 474 is supported on the lower support surface 4116, the upper coupling portion 473 may be supported at the upper portion of the door body 410.

In this regard, the upper coupling portion 473 may be attached to an upper portion of the rear surface of the main panel 440 and coupled to the upper fastener 4117. The upper coupling portion 473 may be fastened to the upper fastener 4117 via a bolt. As a result, the main panel 440 may secure coupling stability at the upper portion of the door body 410.

(b) in FIG. 10 shows a cross-section of a side surface of the door 400. The coupling portion 470 may include the coupling plate 471 seated on the bent surface 412 and the magnet 472 attached to the coupling plate 471 and to which the main panel 440 is coupled. The coupling plate 471 and the magnet 472 may extend along the height direction of the main surface 411 such that the height thereof corresponds to the height of the main surface 411.

In this regard, the thickness of the coupling portion 470 including the coupling plate 471 and the magnet 472 may correspond to that of the step of the bent surface 412. Alternatively, when only the magnet 472 is attached to the bent surface 412, the thickness of the magnet 472 may correspond to that of the step of the bent surface 412. As a result, the main panel 440 is seated and supported on both the main surface 411 and the coupling portion 470, thereby improving the coupling force between the main panel 440 and the door body 410 and enabling the more stable coupling.

(c) in FIG. 10 shows a cross-section of a lower portion of the door 400. Referring to (c) in FIG. 10, the lower coupling portion 474 may be supported on the lower support surface 4116 disposed at the lower portion of the door body 410.

The door body 410 may include a lower protruding rib 41161 that extends from the lower support surface 4116 and protrudes upward from the bottom surface of the door body 410. When the lower coupling portion 474 attached to the main panel 440 is supported on the lower support surface 4116, the lower coupling portion 474 may be seated on and coupled to the lower protruding rib 41161. As a result, the lower coupling portion 474 may be prevented from being removed by pivoting forward at the lower portion of the door body 410, and may be firmly fixed.

The lower coupling portion 474 may include a lower coupling surface (not shown) coupled to the main panel 440, and a seating rib 4741 spaced rearwardly apart from the lower coupling surface and seated on the lower protruding rib 41161.

Specifically, when coupling the main panel 440 to the door body 410, first, the seating rib 4741 of the lower coupling portion 474 may be seated on the lower protruding rib 41161, and when the lower coupling portion 474 pivots forward, the seating rib 4741 may be fixed to the lower protruding rib 41161 and thus the lower coupling portion 474 may be coupled to the door body 410. In this regard, the seating rib 4741 may be in contact with a rear surface of the lower protruding rib 41161 to prevent the seating rib 4741 from pivoting forward. Additionally, the upper coupling portion 473 may be seated on the upper portion of the door body 410 and coupled via the bolt. Accordingly, the main panel 440 may be coupled to the door body 410 via the coupling portion 470.

Conversely, in a case of removing the lower coupling portion 474 from the door body 410, when the lower coupling portion 474 pivots toward the lower protruding rib 41161, the lower coupling portion 474 may move along the lower support surface 4116, and the seating rib 4741 may be removed from the lower protruding rib 41161 and thus the lower coupling portion 474 may be removed from the door body 410. In this regard, the lower support surface 4116 may be inclined upward in a rearward direction to guide the movement of the lower coupling portion 474. Accordingly, the main panel 440 may be rotatably removed from the lower portion of the door body 410 via the lower coupling portion 474.

Additionally, when the main panel 440 is coupled to the door body 410, the main panel 440 is coupled not only to both side surfaces of the door body 410, but also to the upper and lower portions thereof, thereby ensuring stability and coupling strength.

Figure 11:
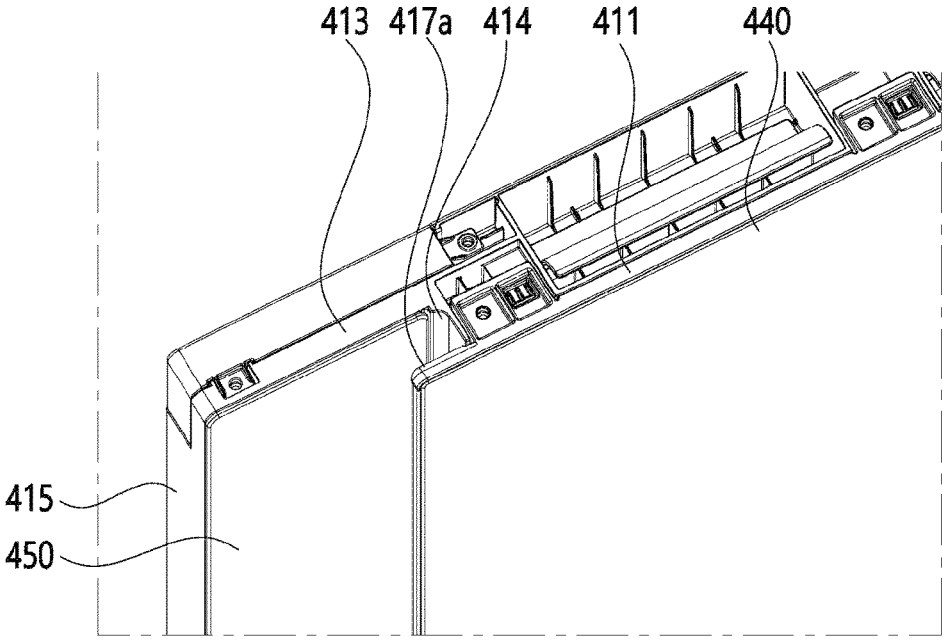
FIG. 11 is an enlarged view of a structure of a handle of the door.

FIG. 11 is an enlarged view of a structure of a handle of the door.

The present disclosure may provide the laundry treating apparatus including the handle 471*a* that is coupled to the bent surface 412 and at least partially overlaps the auxiliary surface 413 in the front and rear direction. Accordingly, the user may easily grip the handle 471*a* and the auxiliary panel 450 may be prevented from being damaged when the user opens the door 400.

The structure of the handle 471*a* will be described in detail with reference to FIG. 11. The handle 471*a* may be formed in a plate shape and have a length corresponding to the height of the bent surface 412 and the auxiliary surface 413. Accordingly, the user may grip the handle 471*a* at any vertical level.

The handle 471*a* may include the coupling surface 4711 seated on the bent surface 412 and the gripping surface 4715 bent forward and extending from the coupling surface 4711, and a width of the coupling surface 4711 may be greater than a width of the gripping surface 4715.

The main panel 440 may be disposed to at least partially overlap the auxiliary surface 413 in the front and rear direction, and the gripping surface 4715 may support the main panel 440. As a result, even when the user applies an external force by gripping the gripping surface 4715, the handle 471*a* may be prevented from pivoting toward the main panel 440 and the step of the bent surface 412 may be complemented.

The door body 410 may further include the coupling hooks 417 that extend to protrude from the main surface 411 toward the bent surface 412 and are disposed to be spaced apart from each other along the height direction of the main surface 411. The coupling surface 4711 may be disposed between the coupling hook 417 and the bent surface 412.

The handle 471*a* may further include the magnet 472 attached to the seating surface 4714 and coupled to the main panel 440, and the coupling hook 417 and the magnet 472 may be disposed in parallel with the main surface 411. That is, the coupling hook 417 and the magnet 472 may protrude to have a thickness corresponding to that of the step of the bent surface 412, so that the main panel 440 may be seated. As a result, the area on which the main panel 440 is seated when being attached to the door body 410 is expanded, so that the main panel 440 may be stably attached to the door body 410.

Figure 12:
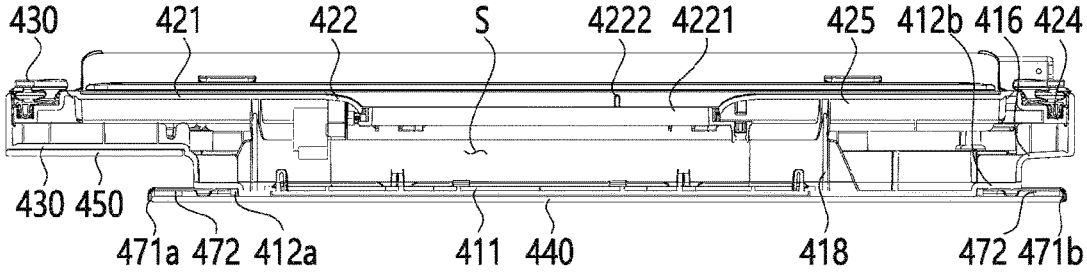
FIG. 12 is a cross-sectional view of the door.

FIG. 12 is a cross-sectional view of the door.

The existing laundry treating apparatus has a structure that allows the machine room 300 and the outside of the door 400 to be in communication with each other. Because the inside of the inner casing 200 is not in direct communication with the outside of the door 400, when the humidity inside the inner casing 200 is high, there is a risk that the inside of the inner casing 200 may be contaminated.

Accordingly, the present disclosure may provide a laundry treating apparatus in which the inside of the inner casing 200 may be in direct contact with the outside of the door 400 to prevent the inside of the inner casing 200 from being contaminated.

Specifically, referring to FIG. 12, the door 400 may be coupled to the cabinet 100 and shield the opening 210, and may include the door body 410 that provides a space through which air introduced from the accommodating space 220 flows, the door sealer 430 that is coupled to the rear surface of the door body 410 to block air in the accommodating space 220 from leaking to the outside, and the inlet 422 that is disposed inwardly of the door sealer 430 and extends through the rear surface of the door body 410 to allow air in the accommodating space 220 to flow into the door body 410.

The door sealer 430 may be inserted into a rear surface of the coupling panel 420. To this end, the coupling panel 420 may further include a sealer fixing hole 424 defined such that a perimeter of a coupling body 421 is recessed and into which the door sealer 430 is inserted. The door sealer 430 may be made of an elastic material such as rubber and may be inserted into the sealer fixing hole 424. When the door 400 closes the opening 210, the door sealer 430 may shield a perimeter of the inner casing 200 to block air from flowing inside and outside the inner casing 200.

In one example, the door 400 may include a chamber duct S formed inside the door body 410 and through which air introduced via the inlet 422 flows. The chamber duct S may be in communication with the inlet 422 and may be disposed at the upper portion of the door body 410. As a result, air inside the inner casing 200 may be introduced via the inlet 422 and flow through the chamber duct S.

The chamber duct S may be disposed between the support panel 4101 and the coupling panel 420. Specifically, the rear surface of the support panel 4101 and a front surface of the coupling panel 420 may be coupled to face each other to form the door body 410.

The door body 410 may include a support chamber 418 that protrudes from the support panel 4101, and a coupling chamber 425 that protrudes from the coupling panel and is coupled to the support chamber to form the chamber duct S.

That is, the chamber duct S may be formed by coupling the support chamber 418 with the coupling chamber 425, so that air introduced via the inlet 422 may flow. As a result, the inside of the inner casing 200 and the door 400 may be in direct communication with each other. As a result, the inside of the inner casing 200 and the door 400 may be in direct communication with each other to adjust the humidity, the temperature, or the like inside the inner casing 200 and prevent the inside of the inner casing 200 from being contaminated.

Figure 13:
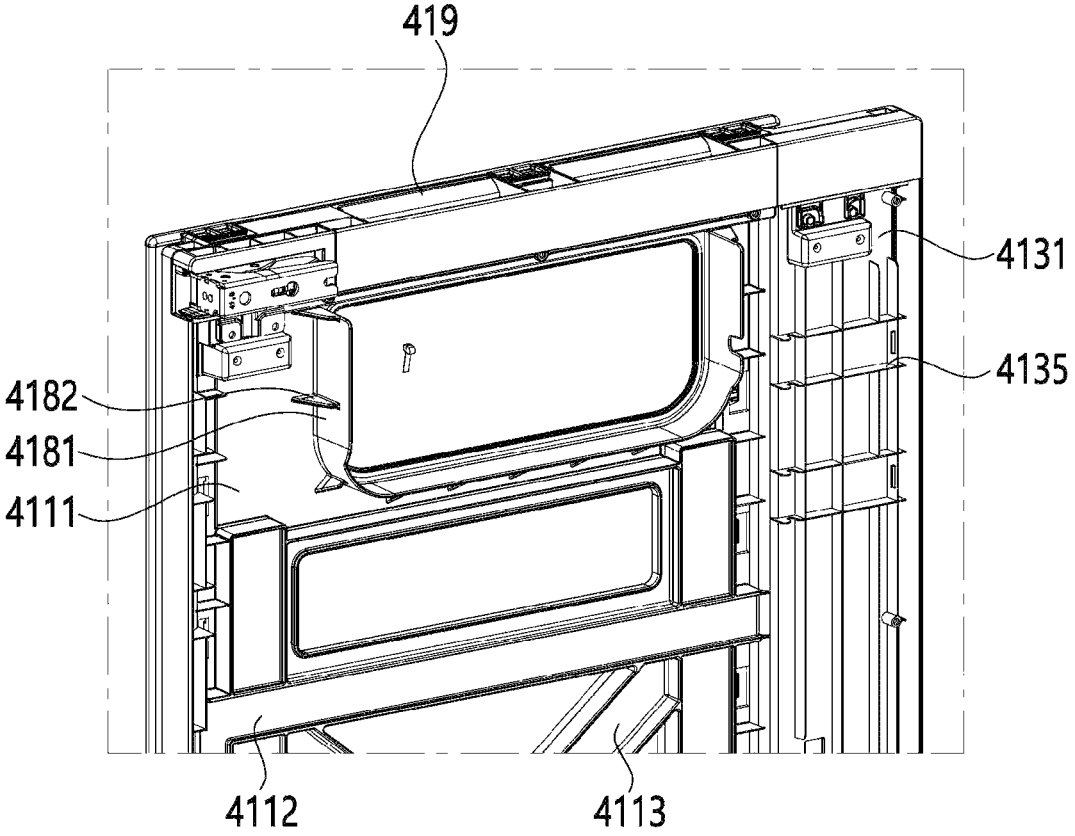
FIG. 13 shows an upper portion of the support panel.

FIG. 13 shows an upper portion of the support panel.

FIG. 13 shows the rear surface of the support panel. Referring to FIG. 13, the support panel 4101 may include a main rear surface 4111 and the auxiliary rear surface 4131 that are disposed to face the main surface 411 and the auxiliary surface 413, respectively, and form the rear surface of the support panel 4101.

The main rear surface 4111 may have the support chamber 418, and the support chamber 418 may be disposed close to the upper portion of the support panel 4101. Specifically, the support chamber 418 may be disposed to face the hanger 510.

The support chamber 418 may include a support chamber body 4181 that protrudes from the support panel 4101 and support chamber ribs 4182 that are formed to be spaced apart from each other along a perimeter of the support chamber body 4181 and guide the coupling of the coupling chamber 425.

The support chamber body 4181 may be formed in a U shape and may serve as a guide flow channel that guides condensed water generated by steam or hot air into the inner casing 200.

In one example, the auxiliary rear surface 4131 may further include the auxiliary rib 4135 that is formed in a grid shape and reinforces the rigidity of the auxiliary surface 413. A density of the auxiliary rib 4135 may be greater than that of the reinforcing rib 4113 disposed on the main surface 411. As a result, the auxiliary surface 413 may be prevented from bending even when the auxiliary panel 450 is attached.

Figure 14:
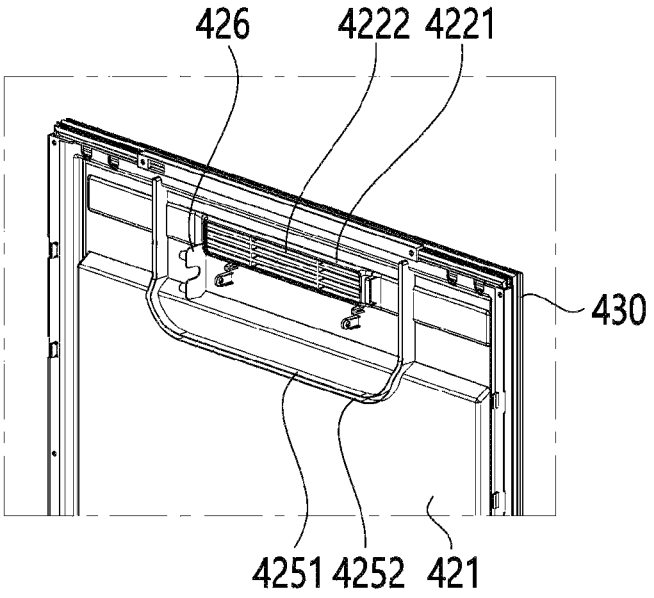
FIG. 14 is an enlarged view of an upper portion of the coupling panel.

FIG. 14 is an enlarged view of an upper portion of the coupling panel.

FIG. 14 shows a rear surface of the coupling panel. Referring to FIG. 14, the inlet 422 may be formed in the coupling panel 420 to allow air from the accommodating space 220 to flow into the door body 410.

Hot air or steam generated in the machine room 300 may flow through the accommodating space 220, then flow into the door body 410 via the inlet 422, and then be discharged via the door 400. Therefore, it is preferable that the inlet 422 is disposed to be accommodated inwardly of the door sealer 430.

Additionally, when the machine room 300 is disposed under the inner casing 200, the inlet 422 may be disposed closer to an upper portion of the coupling panel 420 than to a lower portion thereof. Specifically, the inlet 422 may be disposed to face the hanger 510.

The door 400 may include an inlet body 4221 that protrudes inward from one surface of the door body 410 and forms a perimeter of the inlet 422, a plurality of inlet ribs 4222 that are disposed inside the inlet body 4221 and protrude inward from the one surface of the door body 410, and a plurality of door inlet holes 4223 defined between the plurality of inlet ribs 4222. The inlet body 4221 may be formed in a ring shape, and the inlet ribs 4222 may be formed in a grid shape to define the door inlet holes 4223.

The plurality of inlet ribs 4222 may protrude inward from the one surface of the door body 410 by a length smaller than that of the inlet body 4221.

In one example, the coupling chamber 425 may be disposed on a coupling rear surface 4212, and the coupling chamber 425 may be disposed close to the upper portion of the coupling panel 420. Specifically, the coupling chamber 425 may be disposed to face the hanger 510.

The coupling chamber 425 may include a coupling chamber body (not shown) that protrudes from the rear surface of the coupling panel 420, that is, the coupling rear surface 4212. The coupling chamber body may be formed in a U shape and may serve as a guide flow channel that guides condensed water generated by steam or hot air into the inner casing 200.

The coupling chamber body may include a first body 4251 disposed to surround the inlet 422, and a second body 4252 spaced apart from the first body 4251 and surrounding the first body 4251. The first body 4251 and the second body 4252 may be disposed to be spaced apart from each other and the support chamber body 4181 may be inserted between the first body 4251 and the second body 4252. A thickness of the support chamber body 4181 may correspond to a separation distance between the first body 4251 and the second body 4252. As a result, the chamber duct S may be formed by the first body 4251, the second body 4252, and the support chamber body 4181, thereby providing a space through which air introduced into the inlet 422 may flow.

In one example, the coupling panel 420 may further include a damper installation portion 426 where a damper 480, which will be described later, is installed on the coupling rear surface 4212.

Figure 15:
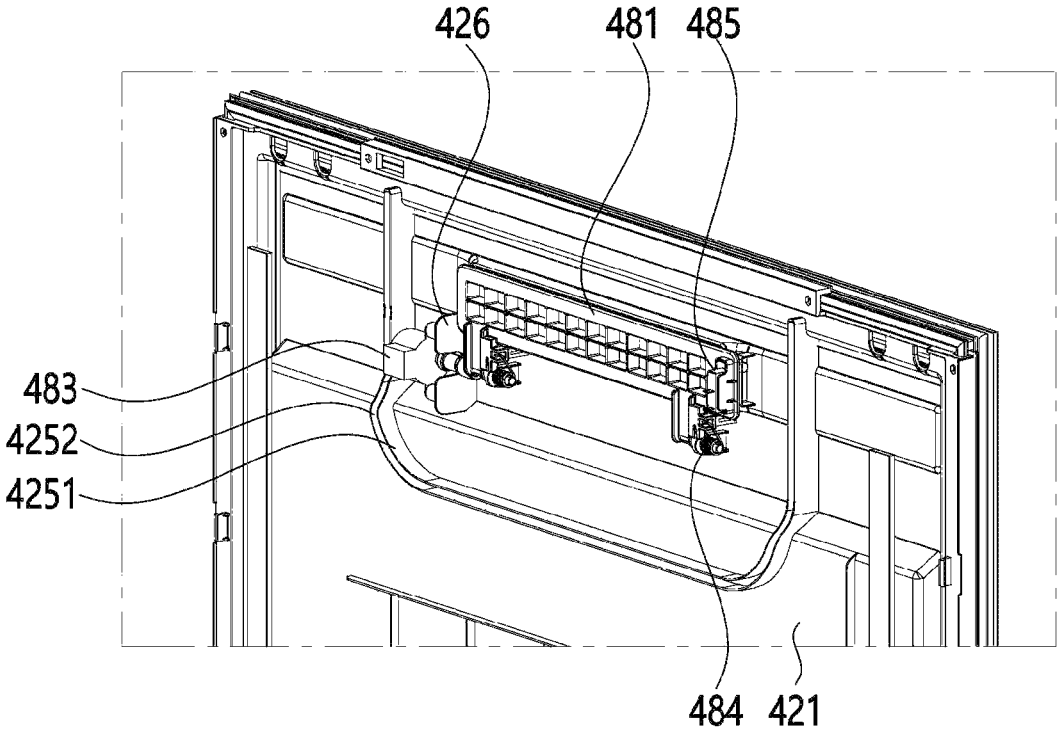
FIG. 15 shows a damper installed in the inlet.
Figure 16:
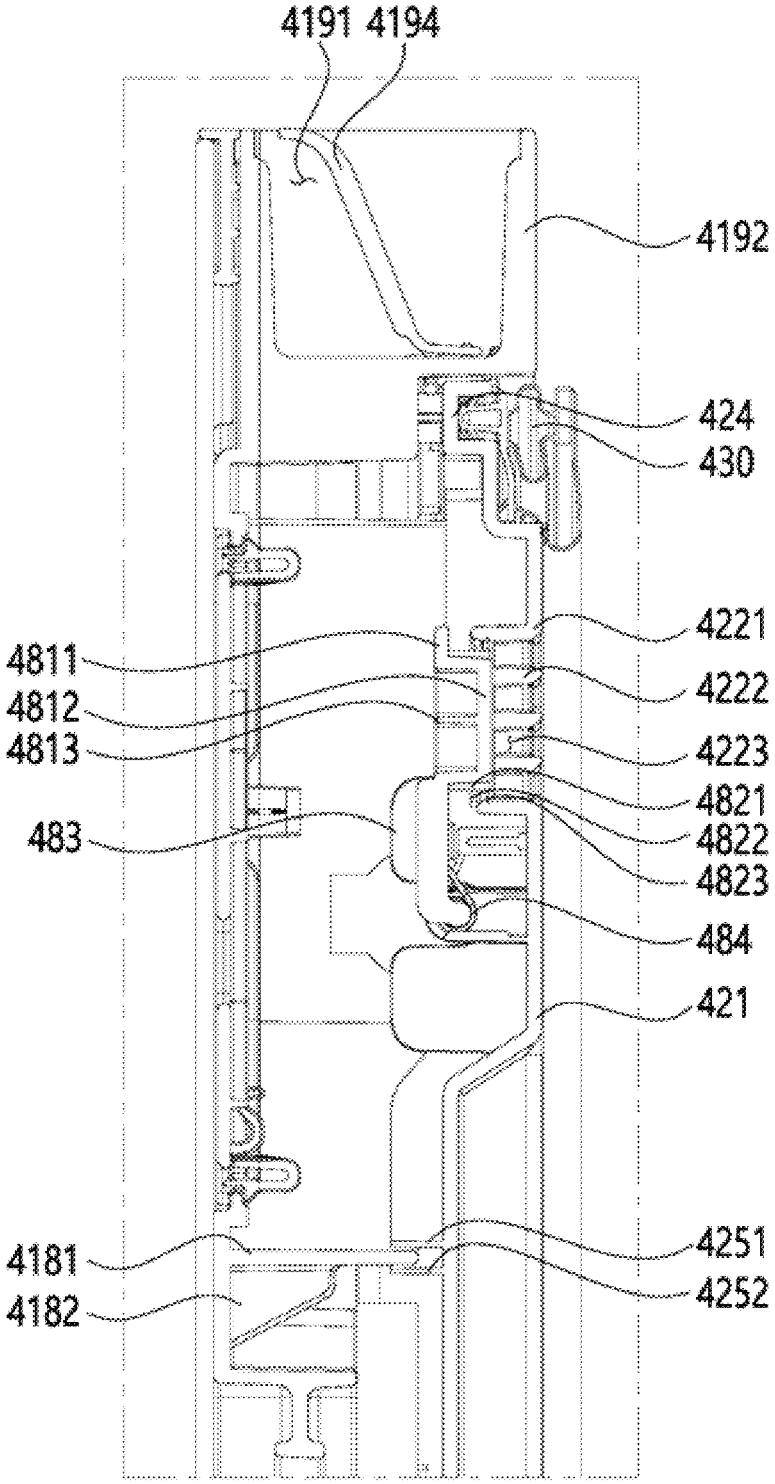
FIG. 16 is a side cross-sectional view of the door.
Figure 17:
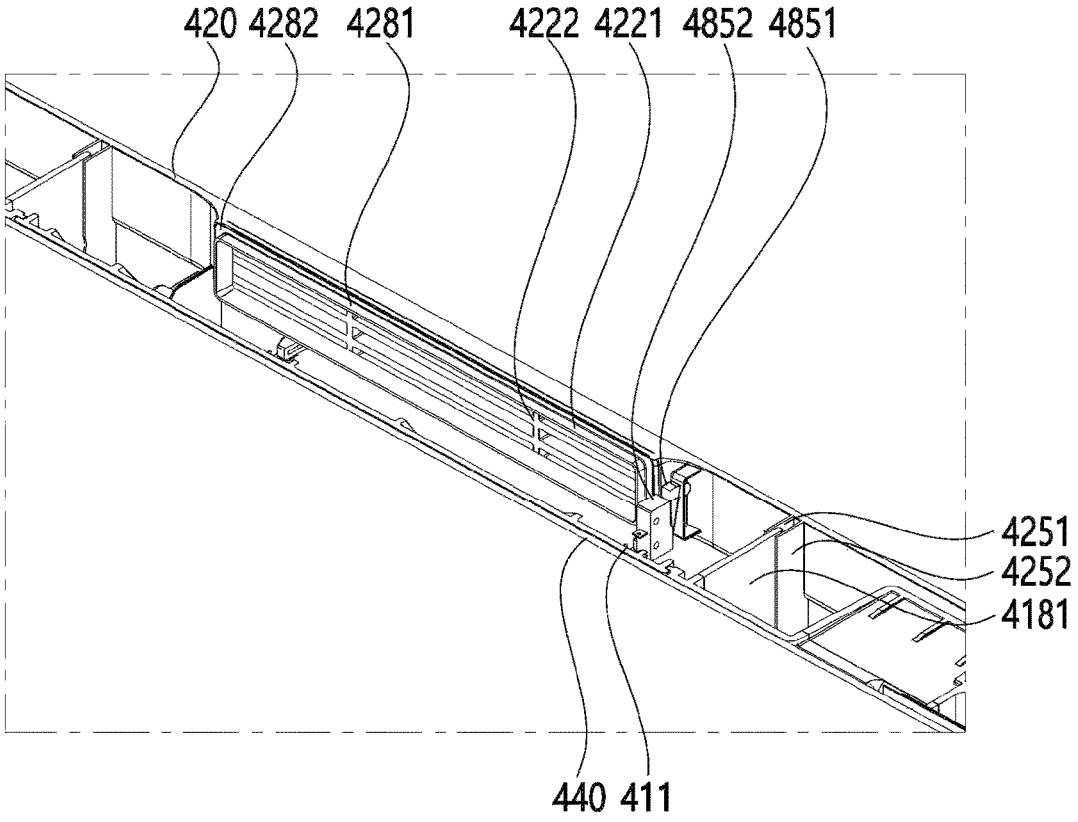
FIG. 17 is a perspective view of the damper.

FIG. 15 shows a damper installed in the inlet, FIG. 16 is a side cross-sectional view of the door, and FIG. 17 is a perspective view of the damper.

In one example, even while the clothes are being treated, when hot air or steam inside the inner casing 200 leaks out of the door 400, a clothes treatment performance may be deteriorated.

Accordingly, the present disclosure may provide a laundry treating apparatus including the damper 480 that is rotatably coupled to the inlet 422 and selectively opens and closes the inlet 422. As a result, the damper 480 may close the inlet 422 to prevent air inside the inner casing 200 from flowing into the inlet 422 during the clothes treatment, and the damper 480 may open the inlet 422 to allow air to be introduced back into the inlet 422 after the clothes treatment is ended.

A structure of the damper 480 will be described in detail with reference to FIGS. 15 and 16. The damper 480 may be disposed inside the chamber duct S. In other words, the damper 480 may be disposed inside the chamber duct S disposed between the support panel 4101 and the coupling panel 420.

Specifically, the damper 480 may include a flap 481 rotatably coupled to the inlet 422 to shield the inlet 422, and a damper sealer 482 coupled to the flap 481 and at least partially inserted into the inlet 422.

The damper sealer 482 may be in contact with an outer side of the inlet 422 or inserted into the inlet 422 to shield the inlet 422. The damper sealer 482 is preferably made of an elastic material such as rubber. A detailed structure of the damper sealer 482 will be described later.

The flap 481 may include a damper body 4811 disposed to be spaced forwardly apart from the inlet 422, and a shielding body 4812 that protrudes rearward from the damper body 4811 and is at least partially inserted into the inlet 422. A perimeter of the damper body 4811 may correspond to or be greater than that of the inlet body 4221, and a perimeter of the shielding body 4812 may be smaller than that of the inlet body 4221 such that the shielding body 4812 is accommodated inside the inlet body 4221 and is in contact with a distal end of the inlet rib 4222.

In one example, the damper 480 may further include a damper driver 483 that is connected to the flap 481 and pivots the flap 481 to selectively open and close the inlet 422. The damper driver 483 may be fixed to the door body and disposed at one side or a lower end of the flap 481.

The damper driver 483 may operate the damper 480 such that the damper 480 may completely close the inlet 422. Specifically, the damper driver 483 may close the inlet 422 by pivoting the flap 481 during the clothes treatment, and may open the inlet 422 by pivoting the flap 481 after the clothes treatment is ended.

In this regard, the controller C may control the flap 481 to selectively open and close the inlet 422 by operating the damper driver 483 depending on whether the clothes are treated.

In one example, the damper 480 may further include an open/close sensor 485 that senses whether the flap 481 has completely shielded the inlet 422. The open/close sensor 485 may determine whether the damper 480 has completely closed the inlet 422 during the clothes treatment and provide information to the controller C. When the controller C determines by the open/close sensor 485 that the damper 480 has not completely closed the inlet 422, the controller C may not start the clothes treatment or stop the clothes treatment by stopping the compressor 342 or the steam supply 800.

Specifically, the open/close sensor 485 may include a switch 4851 that is disposed such that at least a portion thereof is exposed into the door body 410, and a pressurizer 4852 that presses the switch 4851 when the flap 481 pivots to close the inlet 422. When the pressurizer 4852 completely presses the switch 4851, the open/close sensor 485 may sense that the flap 481 has completely shielded the inlet 422.

In one example, the flap 481 may further include a sensor installation hole 4814 extending through a portion of the flap 481 and into which at least a portion of the open/close sensor 485 is installed.

Next, with reference to FIGS. 16 and 17, a structure of the damper sealer 482 will be described in detail.

The damper sealer 482 may include a sealer body 4821 disposed to surround at least a portion of the flap 481. The sealer body 4821 may be formed in a plate shape and may be in contact with the outer side of the inlet 422 to shield an entirety of the inlet 422. However, when the sealer body 4821 is formed in the plate shape, the sealer body 4821 may not completely shield a perimeter of the inlet 422 and air may leak.

Accordingly, the sealer body 4821 may be formed in a ring shape to surround a perimeter of the shielding body 4812 and may be firmly fixed to the shielding body 4812. To this end, the damper sealer 482 may further include a first sealer frame 4822 that protrudes from the sealer body 4821 in a ring shape and is disposed outside the inlet 422, and a second sealer frame 4823 that protrudes in a ring shape so as to be spaced rearwardly apart from the first sealer frame 4822 and is inserted into the inlet 422. As a result, the damper sealer 482 may surround the inlet 422 from outside and inside, thereby completely shielding the perimeter of the inlet 422.

In this regard, a width of the first sealer frame 4822 may be equal to or greater than a width of the inlet 422.

Additionally, the first sealer frame 4822 may be disposed to shield a perimeter of the inlet body 4221, and the second sealer frame 4823 may be disposed to shield the plurality of inlet ribs 4222.

A distance between the first sealer frame 4822 and the second sealer frame 4823 corresponds to a difference between a length at which the inlet body 4221 protrudes from the door body 410 and a length at which the inlet rib 4221 protrudes from one surface of the door body 410. As a result, the first sealer frame 4822 and the second sealer frame 4823 may completely shield the inlet 422.

Figure 18:
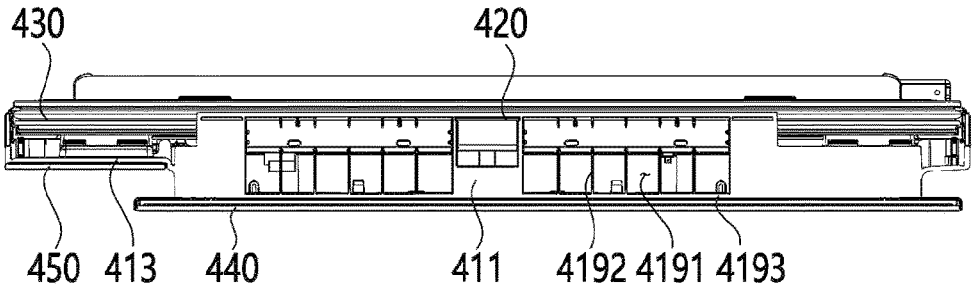
FIG. 18 is a cross-sectional view of an outlet duct of the door.

FIG. 18 is a cross-sectional view of an outlet duct of the door, and FIG. 19 is a top perspective view of the door.

The door 400 may further include the outlet duct 419 that is disposed in a top surface of the door body 410 to be in communication with the inside of the door body 410 and guides air introduced via the inlet 422 to the outside of the door body 410. The outlet duct 419 may be disposed in a top surface of the support panel 4101.

The outlet duct 419 may include an outlet body 4193 disposed at the upper portion of the support panel 4101, outlet holes 4191 defined to be spaced apart from each other inside the outlet body 4193, and outlet ribs 4192 disposed inside the outlet body 4193 to define the outlet holes 4191. The outlet hole 4191 and the outlet rib 4192 may include the plurality of outlet holes and the plurality of outlet ribs, respectively, that are arranged side by side along a width direction of the support panel 4101.

Steam or hot air inside the inner casing 200 may flow into the chamber duct S via the inlet 422, and steam or hot air flowing through the chamber duct S may be discharged to the outside of the door 400 via the outlet hole 4191. As a result, the inside of the inner casing 200 and the door 400 may be in direct communication with each other to adjust the humidity, the temperature, or the like inside the inner casing 200 and may prevent the inside of the inner casing 200 from being contaminated.

The outlet duct 419 may be inclined forward. As a result, air flowing through the chamber duct S may be discharged forwardly of the door 400 via the outlet duct 419, avoiding an obstacle such as a ceiling existing above the laundry treating apparatus.

According to an embodiment, the outlet duct 419 may further include a guide rib 4194 that is inclined forward and guides the discharge of air. The guide rib 4194 may be coupled to the outlet body 4193 at the upper portion of the outlet hole 4191.

Although the present disclosure is shown and described in relation to the specific embodiment, it will be obvious to those skilled in the art that the present disclosure may be improved and changed in various ways without departing from the technical spirit of the present disclosure provided by the following patent claims.

What is claimed is:

1. A laundry treating apparatus comprising:

a cabinet including an opening defined at a front surface of the cabinet;

an inner casing disposed inside the cabinet, the inner casing defining an accommodating space configured to accommodate clothes therein; and a door rotatably coupled to the cabinet and configured to open and close the opening, wherein the door includes:

a door body coupled to the cabinet and configured to shield the opening, a door sealer coupled to a rear surface of the door body and configured to block air in the accommodating space from leaking to an outside of the door, an inlet surrounded by the door sealer, the inlet extending through the rear surface of the door body and being configured to introduce air from the accommodating space into the door body, and a damper rotatably coupled to the inlet and configured to selectively open and close the inlet.

2. The laundry treating apparatus of claim 1, wherein the door further includes a chamber duct provided inside the door body and allowing air introduced via the inlet to flow, and wherein the damper is disposed inside the chamber duct.

3. The laundry treating apparatus of claim 2, wherein the damper includes:

a flap rotatably coupled to the inlet to shield the inlet; and a damper sealer coupled to the flap and at least partially inserted into the inlet.

4. The laundry treating apparatus of claim 3, wherein the damper sealer includes:

a sealer body surrounding at least a portion of the flap;

a first sealer frame protruding from the sealer body in a ring shape and disposed outside the inlet; and a second sealer frame spaced rearwardly apart from the first sealer frame, protruding in a ring shape, and inserted into the inlet, and wherein a width of the first sealer frame is equal to or greater than a width of the inlet.

5. The laundry treating apparatus of claim 4, wherein the door includes:

an inlet body protruding from one surface of the door body and forming a perimeter of the inlet;

a plurality of inlet ribs disposed in the inlet body and protruding from the one surface of the door body; and a plurality of door inlet holes defined between the plurality of inlet ribs, and wherein the first sealer frame shields a perimeter of the inlet body and the second sealer frame shields the plurality of inlet ribs.

6. The laundry treating apparatus of claim 5, wherein the plurality of inlet ribs protrude from the one surface of the door body by a length smaller than a length of the inlet body.

7. The laundry treating apparatus of claim 6, wherein a distance between the first sealer frame and the second sealer frame corresponds to a difference between a length of the inlet body protruding from the door body and a length of the inlet rib protruding from the one surface of the door body.

8. The laundry treating apparatus of claim 3, wherein the flap includes:

a damper body disposed to be spaced forwardly apart from the inlet; and a shielding body protruding rearward from the damper body and at least partially inserted into the inlet.

9. The laundry treating apparatus of claim 3, wherein the damper further includes a damper driver connected to the flap and configured to pivot the flap to selectively open and close the inlet.

10. The laundry treating apparatus of claim 9, wherein the damper driver is fixed to the door body and connected to one side or a lower end of the flap.

11. The laundry treating apparatus of claim 3, wherein the damper further includes an open/close sensor configured to sense whether the flap has completely shielded the inlet.

12. The laundry treating apparatus of claim 11, wherein the open/close sensor includes:

a switch disposed such that at least a portion thereof is exposed into the door body; and a pressurizer configured to press the switch when the flap pivots to close the inlet.

13. The laundry treating apparatus of claim 2, wherein the door includes:

a support panel that defines a front surface of the door body; and a coupling panel coupled to the support panel from a rear side of the support panel, the coupling panel defining the inlet, and wherein the chamber duct is disposed between the support panel and the coupling panel.

14. The laundry treating apparatus of claim 13, wherein the door includes:

a support chamber disposed to protrude from the support panel; and a coupling chamber disposed to protrude from the coupling panel and coupled with the support chamber to form the chamber duct.

15. The laundry treating apparatus of claim 1, wherein the inlet is disposed closer to an upper portion than to a lower portion of the door body.

16. The laundry treating apparatus of claim 15, further comprising a hanger disposed in an upper portion of the inner casing and configured to hang the clothes thereon, wherein the inlet is disposed to face the hanger.

17. The laundry treating apparatus of claim 1, wherein the door further includes an outlet duct disposed in a top surface of the door body to be in communication with an inside of the door body, the outlet duct being configured to guide the air introduced via the inlet to an outside of the door body.

18. The laundry treating apparatus of claim 17, wherein the outlet duct is inclined forward.

19. The laundry treating apparatus of claim 1, wherein the door body defines a space configured to receive the air from the accommodating space introduced through the inlet.

20. The laundry treating apparatus of claim 1, further comprising a machine room disposed below the inner casing, wherein the inner casing defines a plurality of through-holes configured to provide air from the machine room to the accommodating space.

* * * * *